US009985382B2

(12) United States Patent
Matsumoto et al.

(10) Patent No.: US 9,985,382 B2
(45) Date of Patent: May 29, 2018

(54) CONNECTOR HAVING A MECHANISM TO LOCK TWO CONNECTOR MEMBERS TOGETHER

(71) Applicant: J.S.T. Mfg. Co., Ltd., Osaka-shi, Osaka (JP)

(72) Inventors: Hiroyuki Matsumoto, Yokohama (JP); Ho Jin Gang, Gyeonggi-do (KR); Shinya Masada, Yokohama (JP); Saki Katsumoto, Yokohama (JP)

(73) Assignee: J.S.T. MFG. CO., LTD., Osaka-Shi (JP)

( * ) Notice: Subject to any disclaimer, the term of this patent is extended or adjusted under 35 U.S.C. 154(b) by 0 days. days.

(21) Appl. No.: 15/596,441

(22) Filed: May 16, 2017

(65) Prior Publication Data

US 2017/0373433 A1 Dec. 28, 2017

(30) Foreign Application Priority Data

Jun. 23, 2016 (JP) ..... 2016-124107

(51) Int. Cl.

| | |
|---|---|
| ***H01R 13/62*** | (2006.01) |
| ***H01R 13/533*** | (2006.01) |
| ***H01R 13/516*** | (2006.01) |
| ***H01R 13/629*** | (2006.01) |

(52) U.S. Cl.

CPC ..... *H01R 13/533* (2013.01); *H01R 13/516* (2013.01); *H01R 13/62938* (2013.01)

(58) Field of Classification Search

CPC ..... H01R 13/516; H01R 13/62933; H01R 13/62938; H01R 13/62955; H01R 13/62988; H01R 13/633; H01R 13/635

USPC ..... 439/152, 153, 157, 159, 160

See application file for complete search history.

(56) References Cited

U.S. PATENT DOCUMENTS

| | | | | |
|---|---|---|---|---|
| 6,030,235 | A * | 2/2000 | Ittah | H01R 13/62938 439/157 |
| 6,106,312 | A * | 8/2000 | Iwahori | H01R 13/62905 439/157 |
| 6,183,275 | B1 * | 2/2001 | Okura | H01R 13/62933 439/157 |
| 7,794,288 | B2 * | 9/2010 | Shindo | H01R 13/533 439/347 |

(Continued)

FOREIGN PATENT DOCUMENTS

JP 2008-071678 A1 3/2008

*Primary Examiner* — Chandrika Prasad

(74) *Attorney, Agent, or Firm* — Kratz, Quintos & Hanson, LLP

(57) ABSTRACT

Provided is a connector in which first and second connector members are fitted with each other. The first connector member includes a first housing formed with a protrusion. The second connector member includes a second housing; hood member; elastic member; and locking mechanism. The hood member is to cover and to be mounted with the second housing. The elastic member is to be provided between the hood member and second housing. The locking mechanism is to lock the protrusion. The locking mechanism is operated so that the protrusion is drawn in a fitting direction. After the movement of the first and second connector members in the fitting direction is restrained, the locking mechanism is operated so that the hood member is moved while compressing the elastic member, which fix the locking mechanism with the elastic member being compressed.

7 Claims, 19 Drawing Sheets

(56) References Cited

U.S. PATENT DOCUMENTS

| | | | | |
|---|---|---|---|---|
| 2008/0076283 | A1* | 3/2008 | Bouchan | H01R 13/5219 439/157 |
| 2009/0023317 | A1* | 1/2009 | Mizoguchi | H01R 13/62938 439/157 |
| 2010/0151742 | A1 | 6/2010 | Shindo | |

* cited by examiner 204
206
208
210
212
214
215
216
218
220
222
224
225

CONNECTOR HAVING A MECHANISM TO LOCK TWO CONNECTOR MEMBERS TOGETHER

BACKGROUND

Technical Field

The present invention relates to a connector configured to restrain wobbles of connected connectors and have high vibration resistance and durability.

Related Art

For example, the following JP 2008-071678 A discloses an invention relating to a connector having vibration resistance. According to the invention disclosed in JP 2008-071678 A, the connector includes a female first housing, a male second housing, and a hook. The female first housing is configured to support a first connection terminal. The male second housing is configured to support a second connection terminal electrically connected to the first connection terminal and is configured to be inserted into the first housing so as to fit together with the first housing. The hook is hooked on a groove formed in the first housing, stretching along a direction perpendicular to a direction in which the first and second housings are fitted. The hook is also configured to press the second housing along either of a direction perpendicular to the fitting direction and to a direction toward the groove. One of the first and second housings is stretching in the fitting direction and includes a taper-shaped slit rib formed based on a predetermined rate-of-change of width and a predetermined rate-of-change of angle. The other one of the first and second housings is provided to a position corresponding to the slit rib and is stretching along the fitting direction of the first and second housings. The other one of the first and second housings also includes a taper-shaped groove having a rate-of-change of angle and a rate-of-change of width larger than the predetermined rate-of-change of width and the predetermined rate-of-change of angle of the slit rib. When the second housing is fitted with the first housing, an outer wall surface of the slit rib is inserted into an inner periphery of the groove, which makes a slit of the slit rib narrow so that the slit rib is forcibly inserted into the groove.

SUMMARY

In a connector according to the invention disclosed in JP 2008-071678 A, a hook is used to keep a first housing fitted together with a second housing. This hook penetrates fixing grooves of the first and second housings and presses an inclined surface so as to fix the first and second housings.

However, in the connector disclosed in JP 2008-071678 A, a metallic hook is employed so that manufacturing costs may increase, which is a problem to be solved. Since the first and second housings are fixed by elasticity of the hook, there is a possibility that those housings may come off under large pressure.

An object of the present invention is to provide a connector configured to restrain wobbles of connected connectors and have high vibration resistance and durability.

In order to solve the problem mentioned above, a connector according to a first aspect of the present invention includes:

a first connector member; and a second connector member, wherein the first connector member and the second connector member are configured to be fitted with each other, and the first connector member includes a first housing formed with at least one protrusion disposed in a periphery of the first housing, and the second connector member includes a second housing; a hood member; an elastic member; and a locking mechanism, wherein the hood member is configured to cover the second housing and to be mounted with the second housing inside the hood member, and the elastic member is configured to be provided between the hood member and the second housing, and the locking mechanism is configured to lock the protrusion of the first connector member, wherein when connecting the first connector member and the second connector member, the locking mechanism is operated so that the protrusion of the first housing locked in the locking mechanism is drawn in a fitting direction, and the first connector member and the second connector member are moved in the fitting direction, and the first housing and the second housing are at least partially brought into contact with each other, and wherein after the movement of the first connector member and the second connector member in the fitting direction is restrained, the locking mechanism is operated further so that the hood member is moved in the fitting direction while the hood member compresses the elastic member provided between the hood member and the second housing, and the locking mechanism is fixed in a state where the elastic member is compressed.

In regard to a connector of a second aspect, in the connector according to the first aspect, the second connector member includes at least one second contact configured to be brought into contact with at least one first contact provided to the first connector member, wherein the second contact includes a wire configured to be mounted on a side opposite to a side where the second contact is brought into contact with the first contact, and wherein the elastic member is formed with a part configured to be penetrated by the wire.

In regard to a connector of a third aspect, in the connector of the first aspect, the second housing is formed with an enclosure having a tubular shape and configured to contain the elastic member, the enclosure being disposed in a side of the second housing closer to the hood member, wherein the hood member is formed with a spatial part into which the enclosure is to be inserted, the spatial part being disposed in a side of the hood member closer to the second housing, and wherein in connecting the first connector member and the second connector member, when the hood member is moved while compressing the elastic member due to operation of the locking mechanism, the enclosure of the second housing is moved along the spatial part of the hood member.

In regard to a connector of a fourth aspect, in the connector of the first aspect, the locking mechanism includes:

slide members each having a plate-like shape and formed with at least one slide groove which the protrusion is configured to pass through, the slide members being disposed inside the hood member in such a manner that the slide members face each other; and a lever member configured to move the slide member, wherein the slide members are provided inside the hood member in such a manner that the slide members are to be moved reciprocatingly by the lever member in a direction perpendicular to the fitting direction of the first connector member and the second connector member, and wherein when connecting the first connector member and the second connector member, the lever member moves the slide member so that the protrusion is pressed while passing through the slide groove, and the first connector member and the second connector member are moved in the fitting direction.

In regard to a connector of a fifth aspect, in the connector of the fourth aspect, the slide groove has a width allowing the protrusions to pass therethrough, and the slide groove is formed in such a manner that a rear side is inclined further than a front side so that the rear part is apart from a side which is to be connected to the first connector member in a moving direction of the slide member when connecting the first connector member and the second connector member.

In regard to a connector of a sixth aspect, in the connector of the fourth aspect, the lever member includes:

an operation part;

a pair of arms stretching from both ends of the operation part;

a claw-shaped part formed with a plurality of protrusions and disposed in an end of each arm opposite to the operation part; and a shaft formed in a central part of the claw-shaped part, wherein each of the slide members is formed with an engaging part configured to be matched with the claw-shaped part, and the slide members are configured to be moved by rotating the lever member around the shaft.

In regard to a connector of a seventh aspect, in the connector of the first aspect, the first housing and the hood member are formed with at least one vibration-resistant protrusion or at least one vibration-resistant protrusion-inserted groove disposed in parts which are to be adjacent to each other when the first housing is fitted with the hood member, wherein the vibration-resistant protrusion is provided with at least two plate-like protrusions, and the vibration-resistant protrusion-inserted groove is cut into a wedged shape into which the vibration-resistant protrusion is to be inserted, and wherein when fitting the first connector member with the second connector member, the vibration-resistant protrusion is inserted into the vibration-resistant protrusion-inserted groove.

According to the connector of the first aspect, the first and second connector members are fixed while the elastic member provided to the second connector member is pressed so that the second housing is brought into contact with the first housing, while the second housing is constantly pressed in the fitting direction due to elasticity, a property of returning to its original size and shape, of the elastically deformed elastic member. Therefore, it is possible to restrain wobbles and to achieve high durability and vibration resistance.

According to the connector of the second aspect, the elastic member is pressed and elastically deformed so that the part penetrated by the wire is compressed and a diameter of the penetrated part is decreased. Therefore, it is possible to enhance a water proofing property.

According to the connector of the third aspect, it is possible to move the hood member smoothly with a simple structure while the elastic member is compressed.

According to the connector of the fourth aspect, the locking mechanism is configured to include the combined slide members formed with the slide grooves whose number corresponds to the number of the protrusions. Therefore, it is possible to reliably fit those members with each other.

According to the connector of the fifth aspect, by simply allowing the protrusions to pass through the slide grooves of the slide member, it is possible to move the first and second connector members in the fitting direction.

According to the connector of the sixth aspect, the rotation of the lever member leads to the reciprocating movement of the slide member.

According to the connector of the seventh aspect, the first and second connector members are constantly pressed by the compressed elastic member so that the vibration-resistant protrusion fitted into the vibration-resistant protrusion-inserted groove is also constantly pressed. Therefore, it is possible to enhance vibration resistance.

DETAILED DESCRIPTION

An embodiment of the present invention will now be described with reference to the accompanying drawings. Note that the following embodiment is to illustrate a connector for embodying a technical idea of the present invention and that the present invention should not be restricted thereto. The present invention is similarly applicable to other embodiments within the scope of the claims.

Embodiments

Figure 1A:
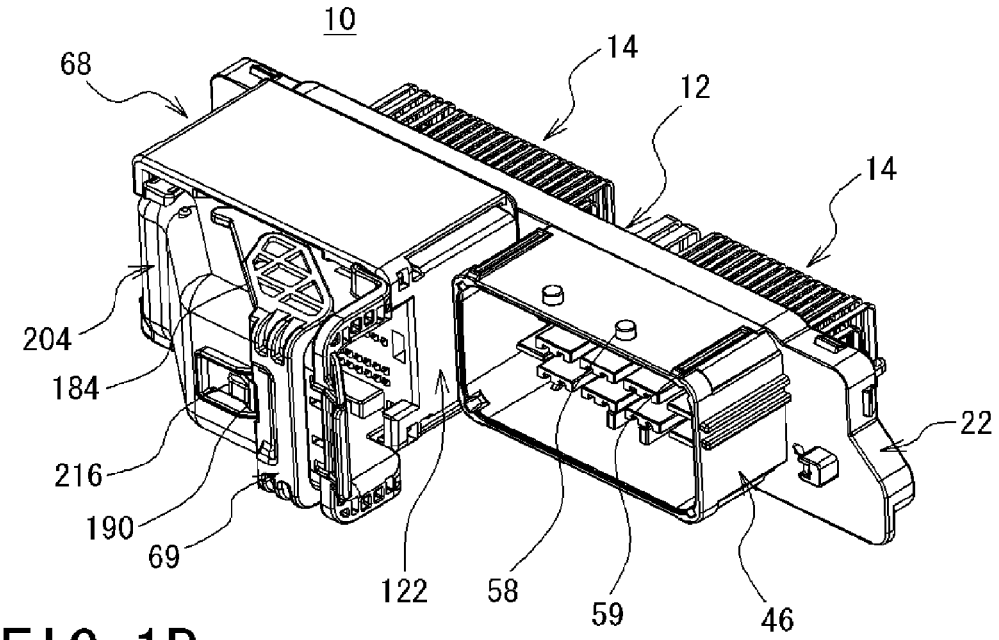
FIG. 1A is a perspective view of a connector according to an embodiment in such a state that first and second connector members are connected to the connector.
Figure 1B:
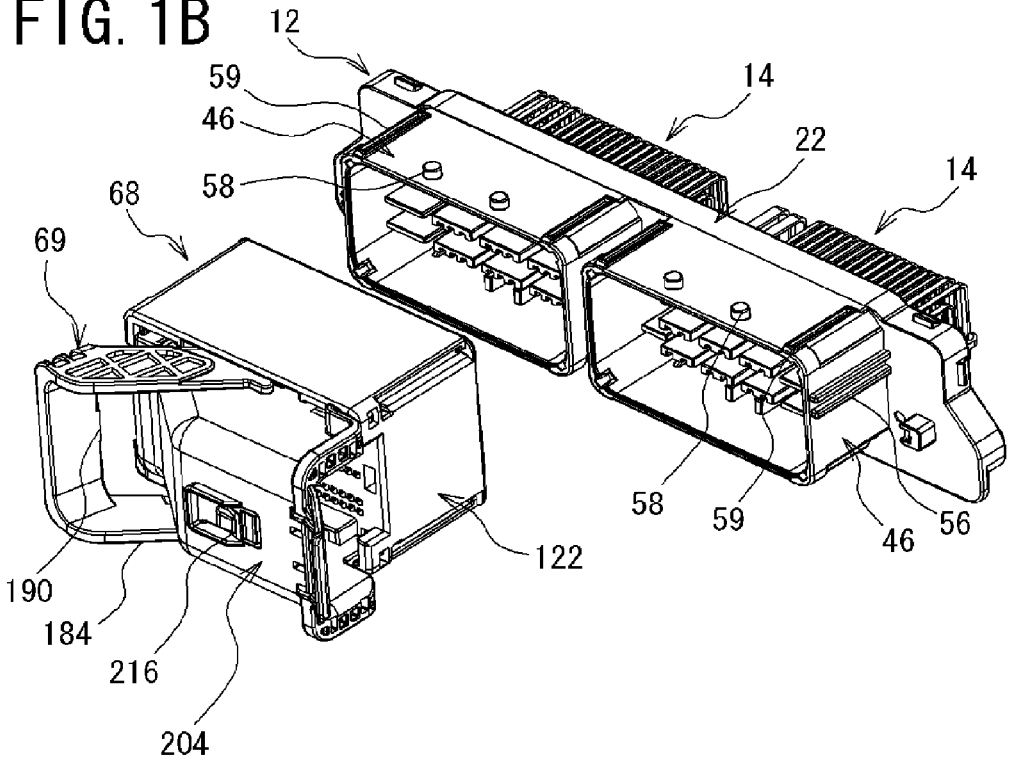
FIG. 1B is a perspective view of the connector before connecting the first and second connector members.
Figure 2A:
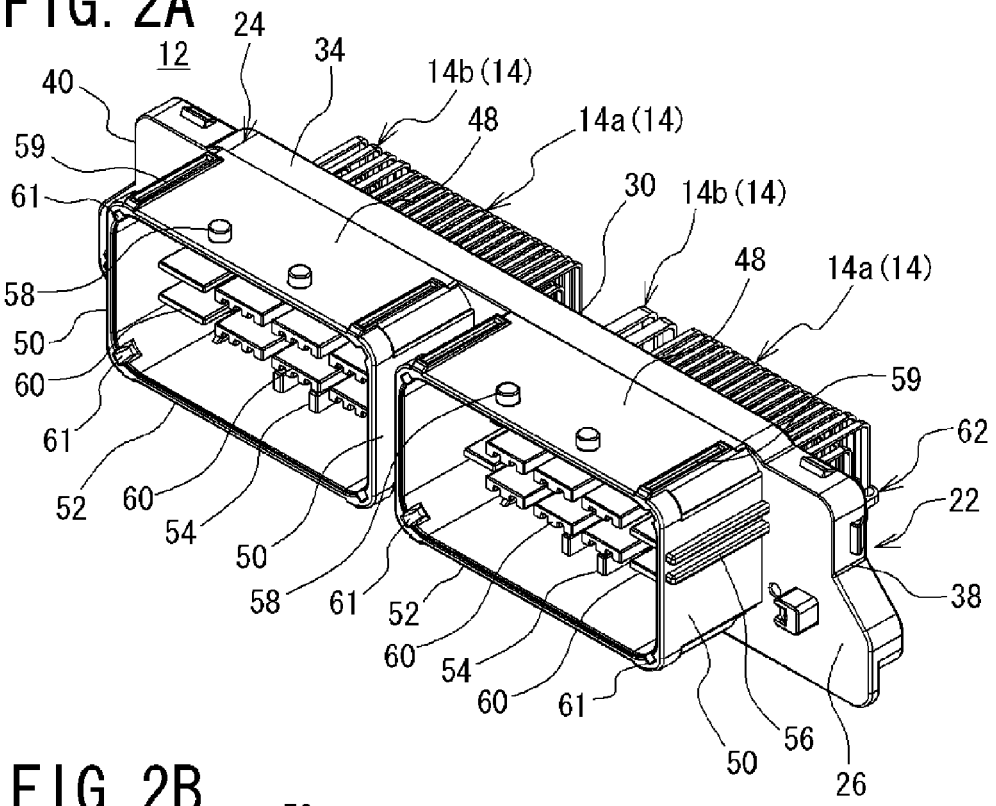
FIG. 2A is a perspective view of the first connector member.
Figure 2B:
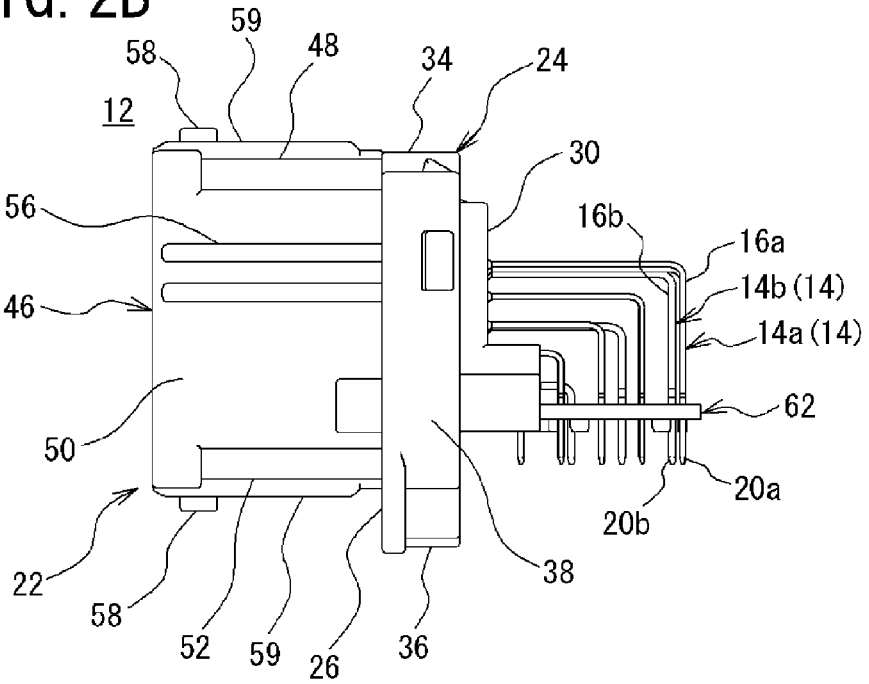
FIG. 2B is a side view of the first connector member seen from one side.
Figure 3A:
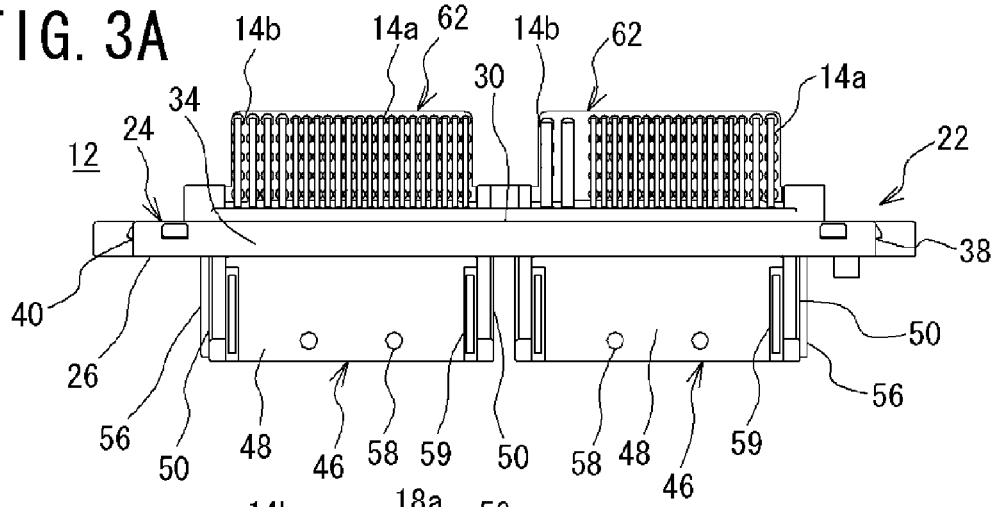
FIG. 3A is a plan view of the first connector member.
Figure 3B:
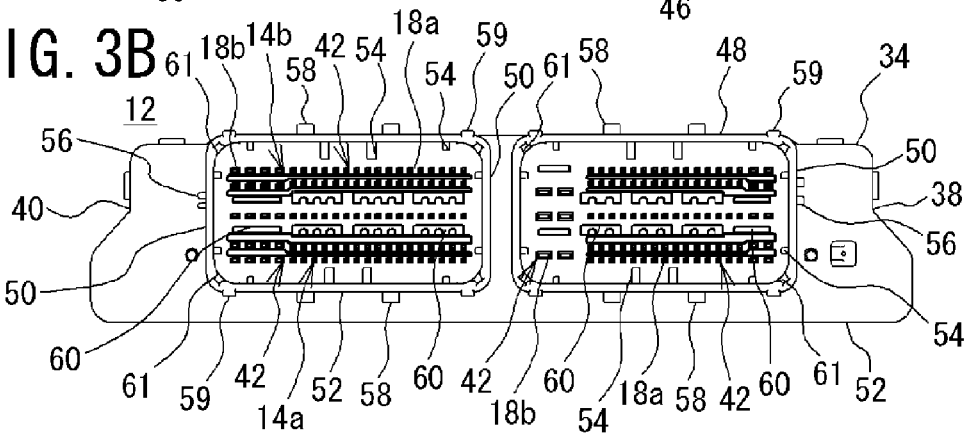
FIG. 3B is a front view of the first connector member.
Figure 3C:
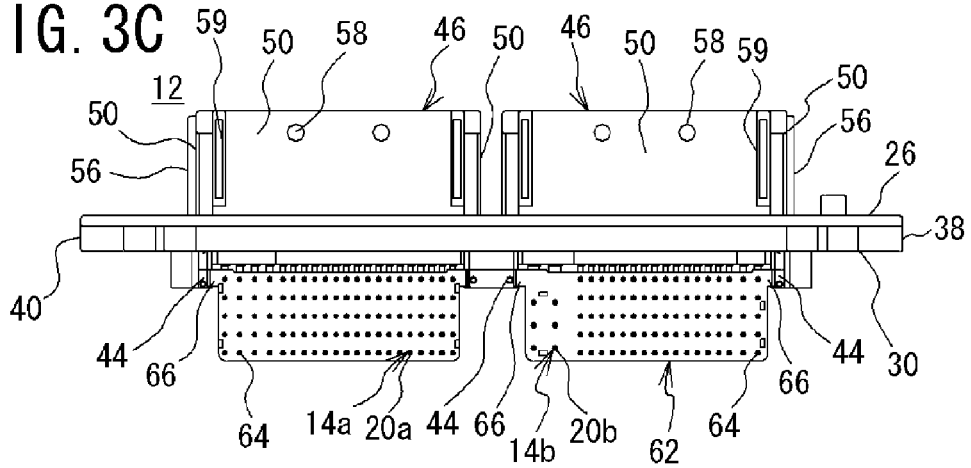
FIG. 3C is a bottom view of the first connector member.

A connector 10 according to an embodiment will now be described with reference to FIGS. 1A to 19B. As illustrated in FIGS. 1A and 1B, the connector 10 of the present embodiment includes a first connector member 12 which is to be mounted on a substrate and the like; and a second connector member 68 which is to be connected to the first connector member 12. The first connector member 12 is configured to be detachable from the second connector member 68. The first and second connector members 12, 68 are provided with a slide member 242 and a lever member 184 included in a locking mechanism 69 configured to fix or release the connection. Herein, the first connector member 12 is a male connector, and the second connector member 68 is a female connector.

First, the first connector member 12 according to the embodiment will be described with reference to FIGS. 1A to 3C. The first connector member 12 includes a plurality of first contacts 14; a first housing 22 equipped with the plurality of first contacts 14; and a smoothing plate 62 mounted on the first housing 22 and configured to align a side of each first contact 14 which is to be connected to the substrate. Note that the first contacts 14 include first contacts for signals 14*a* and first contacts for power source 14*b* arranged in a plurality of steps and rows. Furthermore, the first housing 22, first contacts 14*a*, and first contacts 14*b* are formed in an integrated manner, for example, by insert formation.

In regard to each of the first contacts for signals 14*a* of the first connector member 12, its metallic rod-like body is partially bent and substantially formed in an L-shape. Each of the first contacts 14*a* includes a first contact body 16*a*, a first contacting part 18*a*, and a connecting part 20*a*. The first contacting part 18*a* is provided to one end of the first contact body 16*a* and configured to be brought into contact with a second contact for signals 70*a* (see FIG. 6A) provided to the second connector member 68. The connecting part 20*a* is provided to the other end of the first contact body 16*a* and configured to be connected to the substrate by solder and the like. Note that the first contacts 14*a* of the first connector member 12 are arranged in the plurality of steps and rows so that they are different in length depending on disposition, but are common in configuration.

The first contacts for power source 14*b* of the first connector member 12 are different from the first contacts for signals 14*a* in size, but substantially similar in configuration. A metallic rod-like body of each first contact for power source 14*b* is partially bent and substantially formed in an L-shape. Each of the first contacts 14*b* includes a first contact body 16*b*, a first contacting part 18*b*, and a connecting part 20*b*. The first contacting part 18*b* is provided to one end of the first contact body 16*b* and configured to be brought into contact with a second contact for power source 70*b* (see FIG. 6B) provided to the second connector member 68. The connecting part 20*b* is provided to the other end of the first contact body 16*b* and configured to be connected to the substrate by solder and the like. Hereinafter, the first contacts for signals 14*a* and first contacts for power source 14*b* provided to the first connector member 12 may be collectively referred to as the first contacts 14.

The first housing 22 includes a first housing body 24 provided with a first contact-containing unit 42 in which the plurality of first contacts 14 is contained in an integrated manner. In one end of the first housing body 24, the first contacting parts 18 of the first contacts 14 and a fitting unit 46 to be connected to the second connector member 68 are disposed. In the other side of the first housing body 24, the connecting parts 20 of the first contacts 14 and the smoothing plate 62 are disposed.

The first housing body 24 of the first housing 22 includes a block body having a predetermined width, surrounded by a first front surface 26 from which the first contacting parts 18 of the first contacts 14 are protruded; a first rear surface 30 from which the connecting parts 20 of the first contacts 14 are protruded; a first top surface 34; a first bottom surface 36; and one and the other first side surfaces 38, 40. The first contact-containing unit 42 is formed in accordance with the first contacts 14 to be equipped. In the first contact-containing unit 42, the first contacts for signals 14*a* and first contacts for power source 14*b* slightly larger than those for signals are contained in an integrated manner.

From the first front surface 26 of the first housing body 24, the first contacting parts 18 of the first contacts 14 are protruded, and at least one, herein two tubular fitting units 46 to be connected to the second connector member 68 are stretching in such a manner that these protruded first contacts 14 are surrounded by the fitting units 46. When connecting the first and second connector members 12, 68, these fitting units 46 are inserted into the second connector member 68. Hereinafter, one fitting unit 46 will be described as an example.

The fitting unit 46 is formed in such a manner that a substantially quadrilateral tubular body surrounded by a side 48 closer to the top surface, a side 52 closer to the bottom surface, and both sides 50 closer to the side surfaces is stretching from the first front surface 26 of the first housing body 24 and is integrated with the first housing body 24. Each corner of the fitting unit 46 is formed to have a curved surface.

In regard to the periphery of the tubular body of the fitting unit 46, one side 50 closer to one side surface is formed with an outer guided part 56. When connecting the first and second connector members 12, 68, this outer guided part 56 is guided to a fitting unit-guiding groove 168 (see FIG. 8) formed in a hood member 122 of the second connector member 68. Since the outer guided part 56 is formed in one side 50 closer to one side surface, reverse connection of the second connector member 68 can be avoided.

The sides 48, 52 of the fitting unit 46 closer to the top and bottom surfaces are formed with a plurality of protrusive guided protrusions 59. Each of these guided protrusions 59 is inclined in a direction of insertion or removal of the fitting unit 46. When mounting the hood member 122, the guided protrusions 59 are guided by guiding rail grooves 148 (see FIGS. 8, 9A, and 16A). Furthermore, the guided protrusions 59 perform as a part to release the lock of the slide member 242 inside the hood member 122 when pressing a locking protrusive part 272 (see FIGS. 10A, 10B, and 16A) formed in the slide member 242 to be provided to the hood member 122 (to be mentioned).

Each of the sides 48, 52 of the fitting unit 46 closer to the top and bottom surfaces is formed with at least one, herein two protrusions 58. When the slide member 242 provided to the second connector member 68 (to be mentioned) is interlocked with the lever member 184 configured to reciprocatingly move this slide member 242, these protrusions 58 fit the first and second connector members 12, 68 with each other and also fix or release the connection.

In regard to inner peripheral parts of the sides 48, 52 of the fitting unit 46 closer to the top and bottom surfaces, those parts are formed with a plurality of protrusive inner guided parts 54. When connecting the first and second connector members 12, 68, these inner guided parts 54 are guided by guiding grooves 108 formed in a second housing 84 of the second connector member 68.

A plurality of guided plates 60 protruded from the first front surface 26 of the first housing body 24 is formed inside the fitting unit 46. These guided plates 60 are to be inserted into guiding holes 90 formed in the second housing 84 of the second connector member 68. Herein, there are two types of guided plates 60. That is, a planar type; and a type in which a plate body is formed with a plurality of grooves.

In each corner inside the fitting unit 46 which is to be connected to the second connector member 68, a groove cut into a wedged shape is formed. These wedged grooves perform as first vibration-resistant protrusion-inserted grooves 61 into which first vibration-resistant protrusions 164 formed in the hood member 122 (to be mentioned) are to be inserted.

From the first rear surface 30 of the first housing body 24, the connecting parts 20 of the first contacts 14 are protruded. Furthermore, a side of the first rear surface 30 of the first housing body 24 closer to the first bottom surface 36 is formed with smoothing plate-mounted parts 44 configured to be mounted with the smoothing plate 62.

The smoothing plate 62 includes a plate-like body formed with a plurality of through-holes 64 to be penetrated by the connecting parts 20 of the first contacts 14. The smoothing plate 62 is configured to align the connecting parts 20 and to smooth the connection to the substrate and the like. A side of this smoothing plate 62 which is to be mounted on the first housing 22 is formed with the smoothing plate-mounted parts 44 of the first housing 22 and mounted parts 66 which are to be mounted thereto.

In the first connector member 12 herein, the first housing 22 and the first contacts 14 have been illustrated that they are formed in an integrated manner by the insert formation, but they should not be restricted thereto. A first housing and first contacts may be formed separately and then put together.

Next, the second connector member 68 will be described with reference to FIGS. 1A and 1B and FIGS. 4A to 14B. In the connector 10 herein, two second connector members 68 are provided to the first connector member 12. It should be noted that these second connector members 68 are common in structure except that a part of the structure is formed symmetrically. Hereinafter, one second connector member 68 will be described as an example.

Figure 4A:
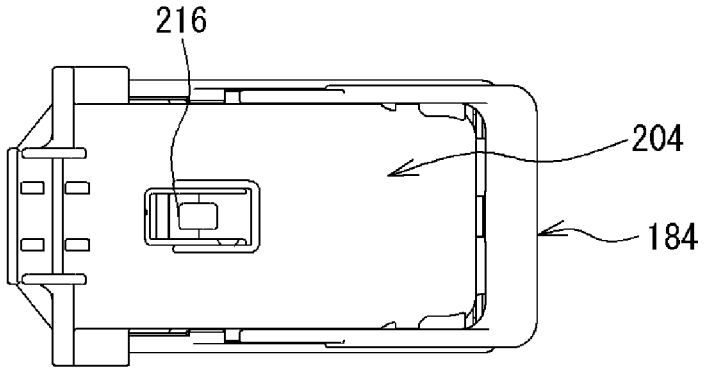
FIG. 4A is a rear view of the second connector member.
Figure 4B:
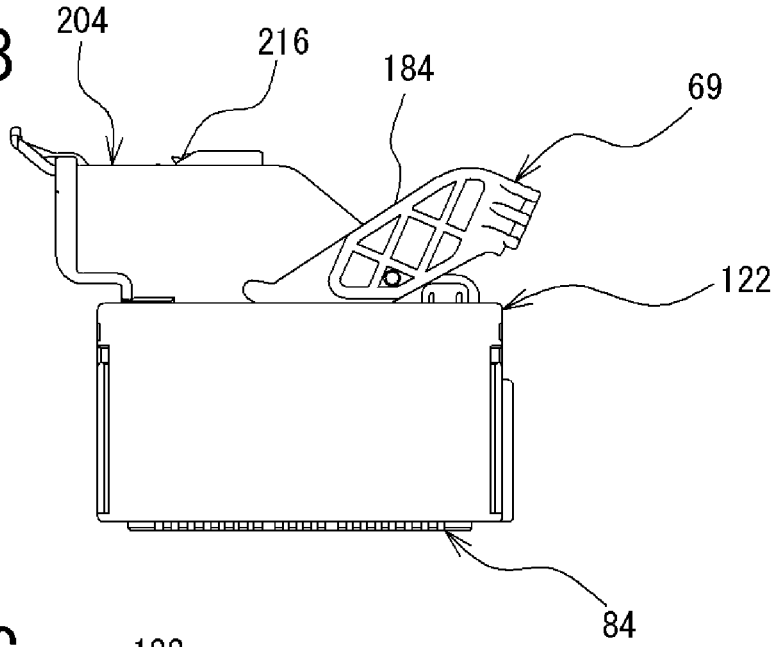
FIG. 4B is a plan view of the second connector member.
Figure 4C:
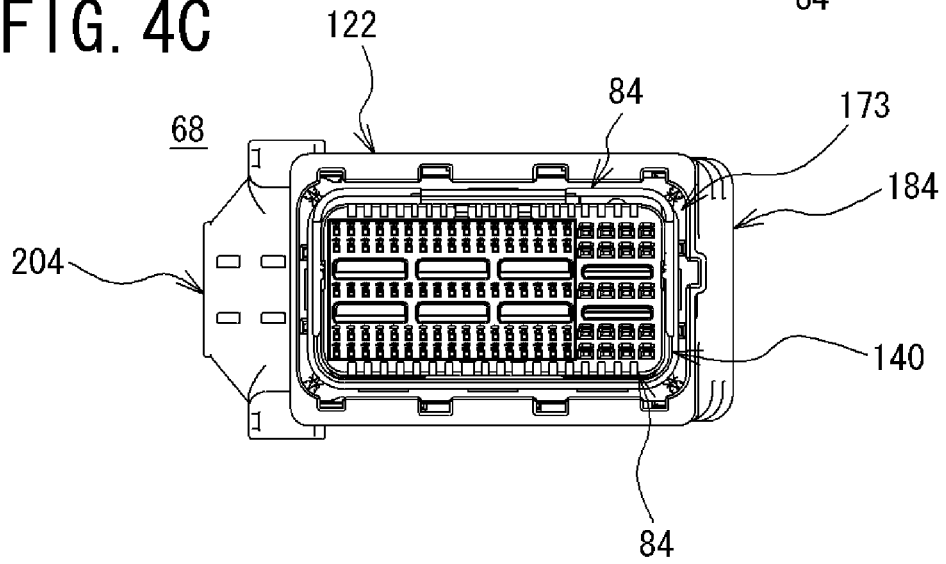
FIG. 4C is a front view of the second connector member.
Figure 5:
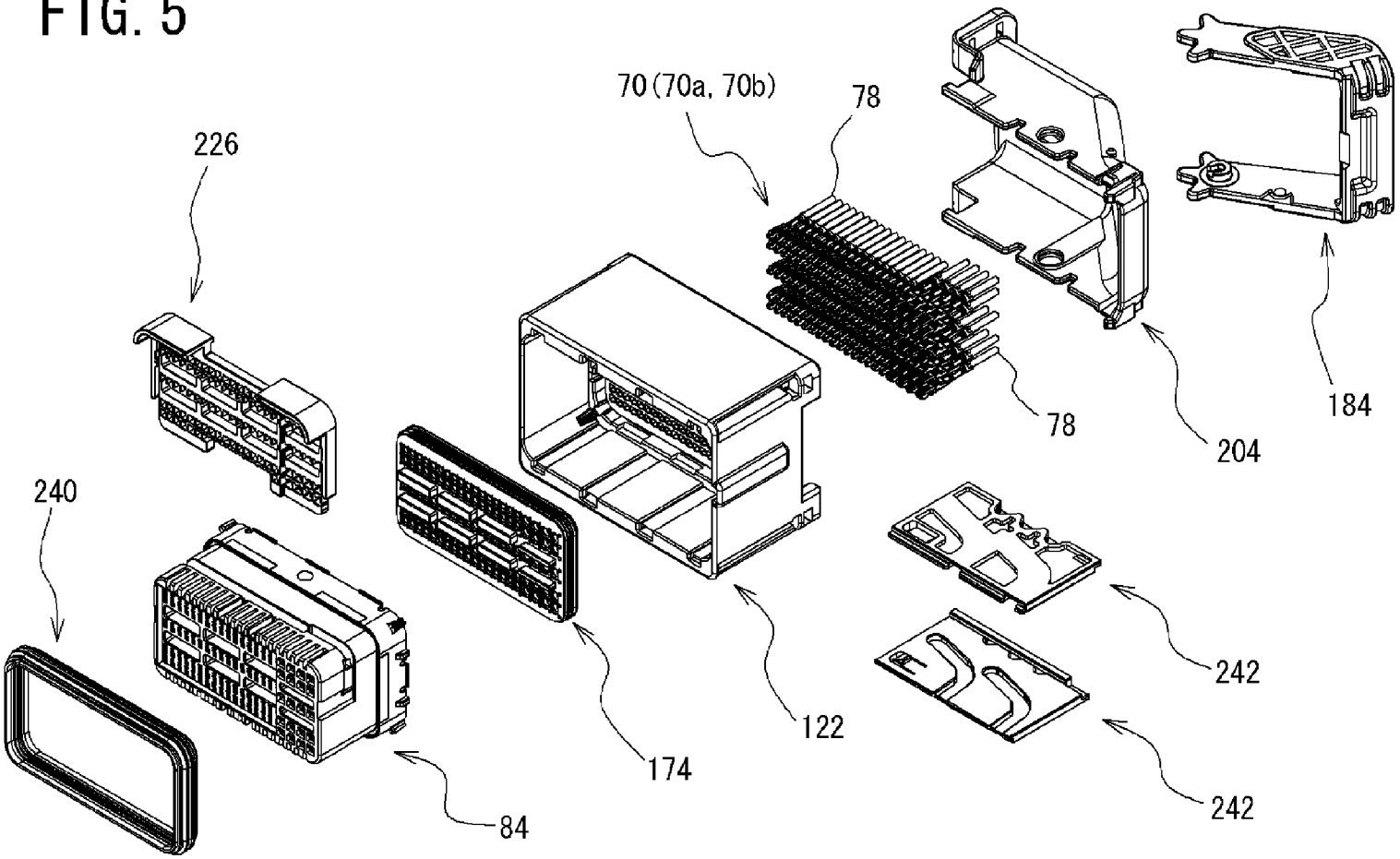
FIG. 5 is a perspective view illustrating the second connector member taken apart.
Figure 6A:
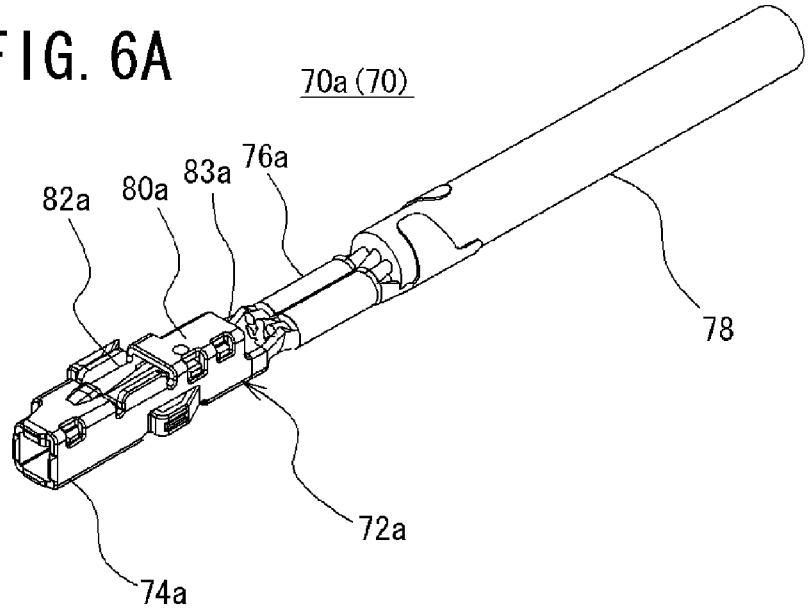
FIG. 6A is a perspective view of a second contact for signals.
Figure 6B:
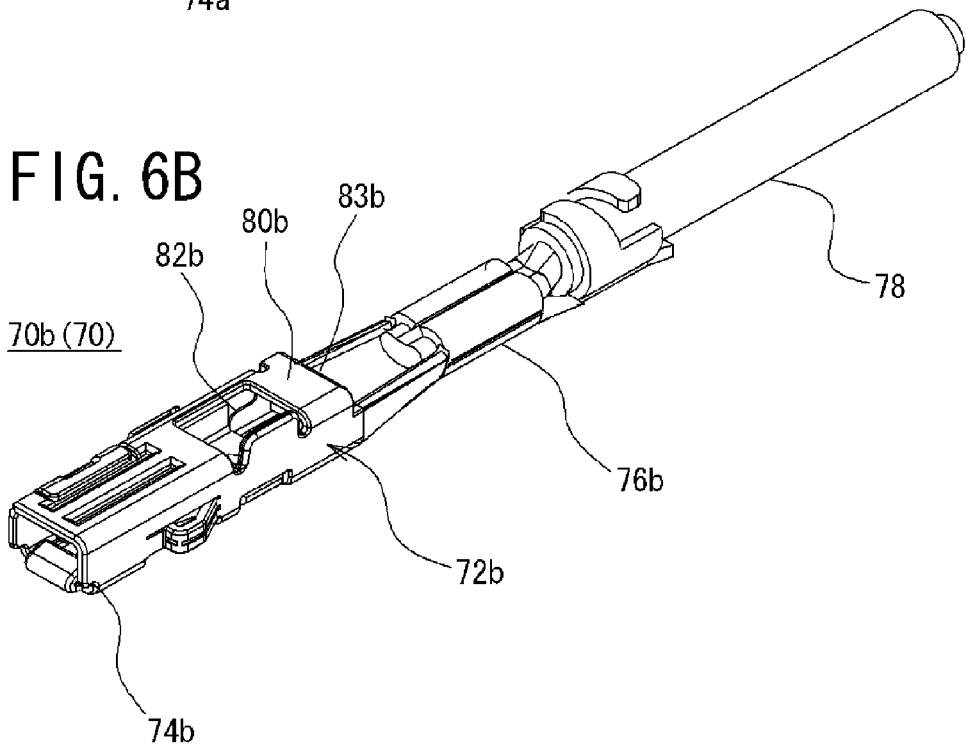
FIG. 6B is a perspective view of the second contact for power source.

As illustrated in FIGS. 4A to 5, the second connector member 68 includes: a plurality of second contacts 70 to which wires 78 are connected; the second housing 84 formed with a second contact-containing unit 120 configured to contain the plurality of second contacts 70; a retainer 226 configured to position and fix the second contacts 70 contained in the second housing 84; a seal member 240 provided to the periphery of the second housing 84 in an annular manner; the hood member 122 provided so as to cover the second housing 84; a wire seal 174 performing as an elastic member, provided between an inside of the hood member 122 and the second housing 84; a cover member 204 provided to a side of the hood member 122 opposite to a side to be connected to the first connector member 12; the lever member 184 rotatably provided to the cover member 204; and a pair of slide members 242 provided inside the hood member 122 and reciprocatingly moved by the lever member 184. Herein, the lever member 184 and slide members 242 are included in the locking mechanism 69. In regard to the second contacts 70, the second contacts for signals 70*a* as in FIG. 6A and the second contacts for power source 70*b* as in FIG. 6B are arranged in a plurality of steps and rows.

First, the second contacts for signals 70*a* will be described as follows. As illustrated in FIG. 6A, each second contact for signals 70*a* includes a tubular second contact body 72*a*; a second contacted part 74*a*, and a wire-equipped part 76*a*. The second contacted part 74*a* is provided to one end of the second contact body 72*a* and configured to be brought into contact with the inserted first contacting part 18*a* of the first contact for signals 14*a*. The wire-equipped part 76*a* is provided to the other end of the second contact body 72*a* and configured to be equipped with the wire 78. An upper side 80*a* of the second contact body 72*a* is formed with an inserted part 82*a* into which a claw-shaped lance (not illustrated) is to be inserted. The claw-shaped lance is provided inside the second contact-containing unit 120 of the second housing 84 (to be mentioned). Furthermore, a side of the second contact body 72*a* closer to the wire-equipped part 76*a* is formed with a fixed part 83*a* configured to be positioned and fixed when engaged with a fixing protrusion 232 of the retainer 226.

Next, the second contacts for power source 70*b* will be described as follows. As illustrated in FIG. 6B, the second contacts for power source 70*b* are substantially common with the second contacts for signals 70*a* in structure. Each second contact for power source 70*b* includes a tubular second contact body 72*b*, a second contacted part 74*b*, and a wire-equipped part 76*b*. The second contacted part 74*b* is provided to one end of the second contact body 72*b* and configured to be brought into contact with the inserted first contacting part 18*b* of the first contact for power source 14*b*. The wire-equipped part 76*b* is provided to the other end of the second contact body 72*b* and configured to be equipped with the wire 78. An upper side 80*b* of the second contact body 72*b* is formed with an inserted part 82*b* into which the claw-shaped lance (not illustrated) is to be inserted. The claw-shaped lance is provided inside the second contact-containing unit 120 of the second housing 84 (to be mentioned). Furthermore, a side of the second contact body 72*b* closer to the wire-equipped part 76*b* is formed with a fixed part 83*b* configured to be positioned and fixed when engaged with the fixing protrusion 232 of the retainer 226. Hereinafter, the second contacts for signals 70*a* and second contacts for power source 70*b* provided to the second connector member 68 may be collectively referred to as the second contacts 70.

Figure 7A:
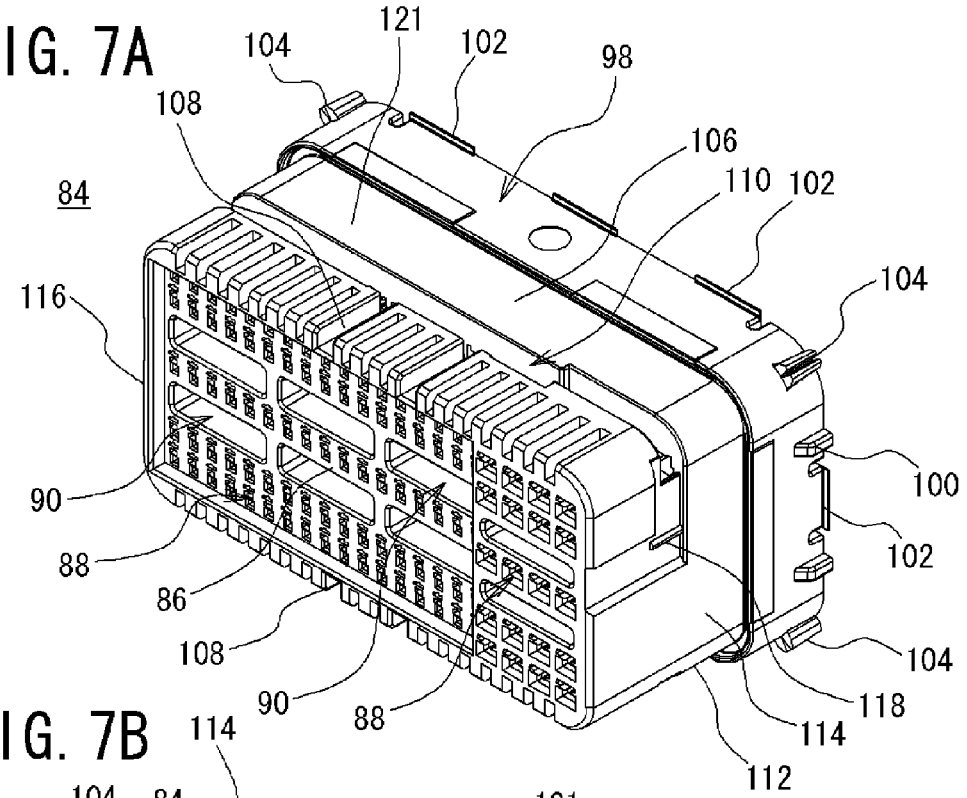
FIG. 7A is a perspective view of a second housing seen from one side.
Figure 7B:
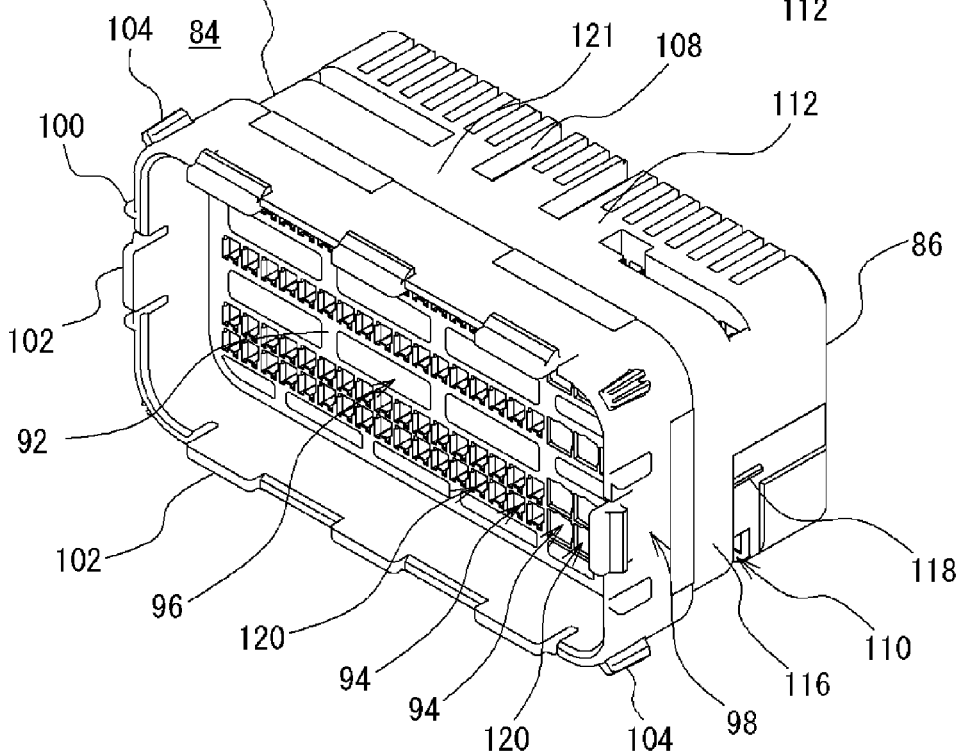
FIG. 7B is a perspective view of the second housing, turning the view in FIG. 7A upside down.
Figure 8:
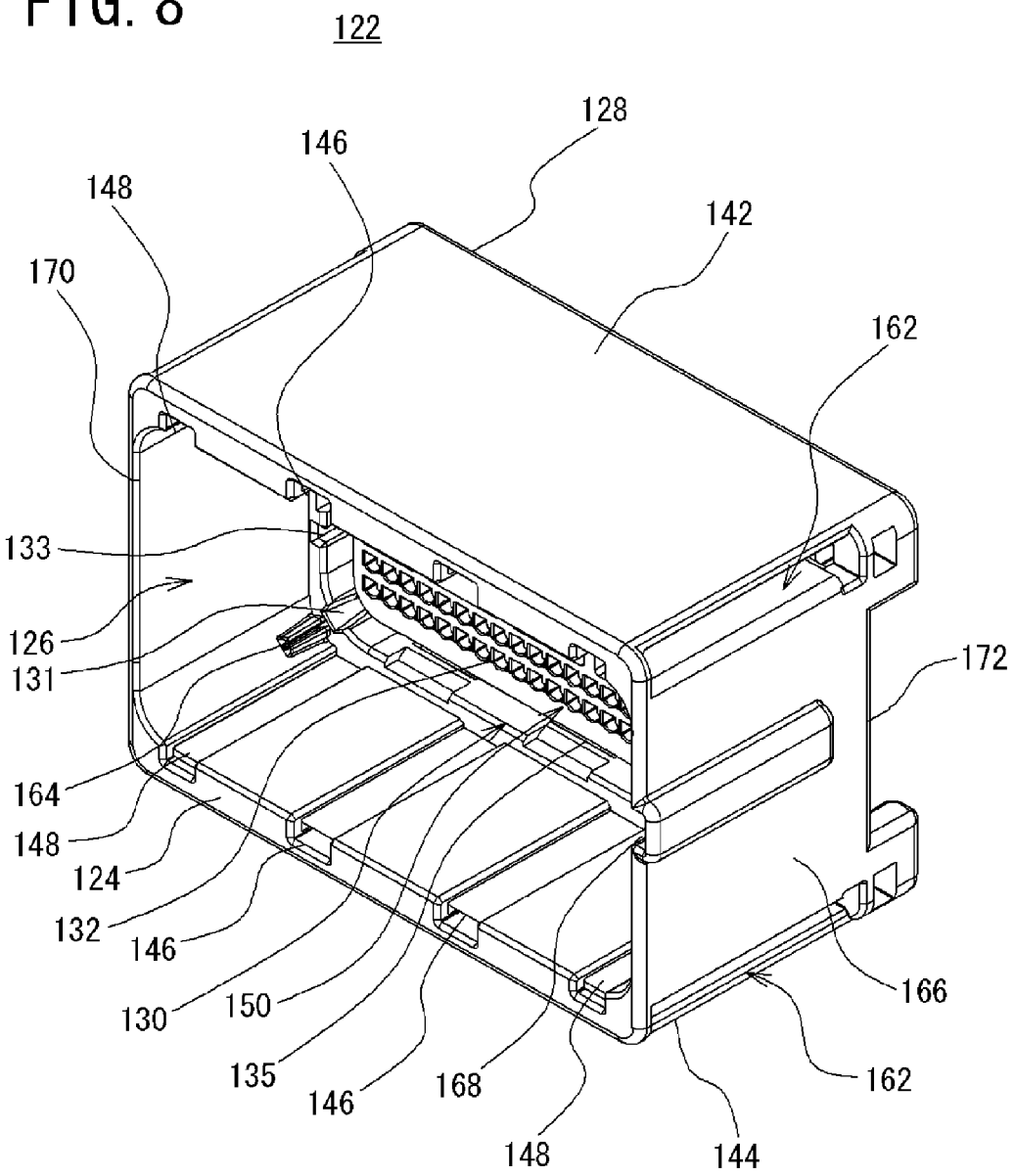
FIG. 8 is a perspective view of a hood member seen from one side.

Next, the second housing 84 will be described with reference to FIGS. 7A and 7B. The second housing 84 is formed of a resin material and includes a block body having a second front surface 86, a second rear surface 92, a second top surface 106, a second bottom surface 112, and one and the other second side surfaces 114, 116. The second front surface 86 is formed with a plurality of first contact-inserted parts 88 into which the first contacts 14 of the first connector member 12 to be connected to the second contacts 70 contained inside the second housing 84 are to be inserted. The second rear surface 92 is formed with a plurality of second inserted holes 94 into which the second contacts 70 are to be inserted. The second top surface 106 is formed with a retainer-equipped groove 110 configured to be equipped with the retainer 226. The second bottom surface 112 is disposed in an opposite side of the second top surface 106. Inside the second housing 84, the second contact-containing unit 120 configured to contain the plurality of second contacts 70 is formed in such a manner that the second inserted holes 94 and the first contact-inserted parts 88 formed in the second front surface 86 are linked to each other.

In regard to the second front surface 86 of the second housing 84, the plurality of first contact-inserted parts 88 into which the first contacting parts 18 of the first contacts 14 are to be inserted and the plurality of guiding holes 90 into which the guided plates 60 formed in the first housing 22 are to be inserted are formed throughout the inside of the second housing 84.

The second rear surface 92 of the second housing 84 is formed with the second inserted holes 94 into which the second contacts 70 are to be inserted and which are communicated with the second contact-containing unit 120. The second rear surface 92 is also formed with wire seal-inserted grooves 96 configured to be fitted with inserting protrusions 178 (see FIG. 11A) formed in the wire seal 174 which is to be disposed in a side closer to the second rear surface 92. The second inserted holes 94 are formed in such a manner that the second contacts for signals 70*a* and the second contacts for power source 70*b* slightly larger than those for signals can be inserted.

In the periphery of the second rear surface 92, that is, in the second top surface 106, second bottom surface 112, and one and the other second side surfaces 114, 116, a tubular enclosure 98 is formed, stretching from the second rear surface 92. This enclosure 98 is a part where the wire seal 174 is to be contained and which is to be mounted on a second housing-mounted part 130 formed in the hood member 122. Each side of the enclosure 98 closer to one and the other second side surfaces 114, 116 is formed with hood member-guiding parts 100. When mounting the second housing 84 on the second housing-mounted part 130 (see FIG. 9A) of the hood member 122, these hood member-guiding parts 100 guide the insertion of the second housing 84. A plurality of hood member-mounted parts 102 is formed in each side of the enclosure 98 closer to the second top surface 106, the second bottom surface 112, and one and the other second side surfaces 114, 116. The hood member-mounted parts 102 are to be mounted on the second housing-mounted part 130 of the hood member 122.

In the second top surface 106 of the second housing 84, the retainer-equipped groove 110 configured to be equipped with the retainer 226 is formed from one second side surface 114 to the other second side surface 116. Furthermore, a part of the second top surface 106 closer to the second front surface 86 is formed with the guiding grooves 108 configured to guide the inner guided parts 54 of the first housing 22.

The second bottom surface 112 of the second housing 84 is also formed with the guiding grooves 108 configured to guide the inner guided parts 54 of the first housing 22.

Each of one and the other second side surfaces 114, 116 is formed with a retainer-locking protrusion 118 configured to lock the retainer 226 which is to be equipped from the second top surface 106.

Each peripheral corner of the enclosure 98 of the second housing 84 is formed with a protrusive second vibration-resistant protrusion 104. Each second vibration-resistant protrusion 104 has two rows of plate-like protrusions. As approaching the second front surface 86, a width between the two rows of the plate-like protrusions is made thick. In other words, each second vibration-resistant protrusion 104 is spreading like an unfolded fan. In assembling the second connector member 68, these second vibration-resistant protrusions 104 are to be fitted in second vibration-resistant protrusion-inserted grooves 131 (see FIGS. 8 and 9A) formed in the hood member 122 (to be mentioned).

Next, the hood member 122 will be described with reference to FIGS. 8, 9A, 9B, 16A, and 16B. The hood member 122 is formed of a resin material and includes a box-like body having a front face 124, a rear face 128, a top face 142, a bottom face 144, and one and the other side faces 166, 170. The second housing 84 is to be inserted into the front face 124. Furthermore, the front face 124 is formed with an opening 126 configured to be fitted with the fitting unit 46 of the first housing 22 of the inserted first connector member 12. The rear face 128 is formed with wire-penetrated holes 132 which are to be penetrated by a plurality of wires 78.

The second housing-mounted part 130 configured to be mounted with the second housing 84 is formed inside the hood member 122, closer to the rear face 128. The second housing-mounted part 130 is formed with grooves 133 disposed in inner sides of one and the other side faces 166, 170. The grooves 133 are to be guided by the hood member-guiding parts 100 formed in the periphery of one and the other second side surfaces 114, 116 of the enclosure 98 of the second housing 84. In mounting the second housing 84, the grooves 133 are guided by the hood member-guiding parts 100.

Furthermore, the second housing-mounted part 130 is formed with engaged parts 135 disposed in the periphery of the enclosure 98 of the second housing 84. The engaged parts 135 are to be mounted with the hood member-mounted parts 102. In mounting the second housing 84, the engaged parts 135 are engaged with the hood member-mounted parts 102.

Still further, each corner of the second housing-mounted part 130 is formed with a wedged second vibration-resistant protrusion-inserted groove 131 configured to be fitted with each second vibration-resistant protrusion 104 formed in the periphery of the enclosure 98 of the second housing 84. In mounting the second housing 84 on the hood member 122, once the second vibration-resistant protrusions 104 spreading like an unfolded fan, formed in the enclosure 98 of the second housing 84 are fitted with the second vibration-resistant protrusion-inserted grooves 131, the second vibration-resistant protrusions 104 are deformed in such a manner that the width thereof becomes narrow. Accordingly, the second vibration-resistant protrusions 104 and second vibration-resistant protrusion-inserted grooves 131 are engaged with no space so that the second housing 84 and hood member 122 are fixed. Therefore, it is possible to achieve high durability with respect to vibration and the like.

Note that a surface inside the hood member 122 closer to the rear face 128 performs as a wire seal-contacted surface 150 to be brought into contact with the wire seal 174 (to be mentioned) when assembling the second connector member 68.

Inside the hood member 122, each corner of a side closer to the front face 124 than the second housing-mounted part 130 is formed with the protruded first vibration-resistant protrusion 164. These first vibration-resistant protrusions 164 are to be fitted with the first vibration-resistant protrusion-inserted grooves 61 formed in the fitting unit 46 of the first housing 22. Similarly to the second vibration-resistant protrusions 104 mentioned above, each first vibration-resistant protrusion 164 has two rows of plate-like protrusions. As approaching the rear face 128, a width between the two rows of the plate-like protrusions is made thick. In other words, each first vibration-resistant protrusion 164 is spreading like an unfolded fan. When connecting the first and second connector members 12, 68, the first vibration-resistant protrusions 164 are fitted with the wedged first vibration-resistant protrusion-inserted grooves 61, which leads to achievement of high vibration resistance as similar to the aforementioned case of fitting the second vibration-resistant protrusions 104 and second vibration-resistant protrusion-inserted grooves 131.

In a case of mounting the second housing 84 on the hood member 122, note that a space 173 is formed between the periphery of the second housing 84 and the inside of the hood member 122. This space 173 is where the fitting unit 46 of the first connector member 12 is to be fitted when connecting the first and second connector members 12, 68 (see FIGS. 4C, 16B).

Figure 16B:
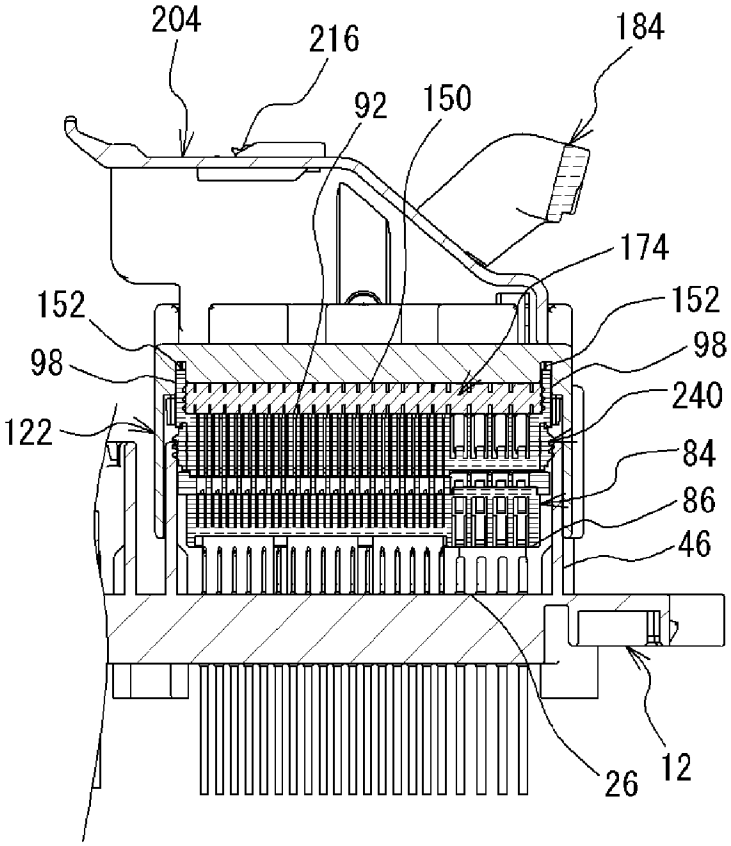
FIG. 16B is a cross sectional view taken along the line XVIB-XVIB in FIG. 15A.

The second housing-mounted part 130 of the hood member 122 is also formed with an annular spatial part 152 so that the enclosure 98 of the second housing 84 can be inserted thereinto (see FIG. 16B). In a state where the second housing 84 and hood member 122 are assembled, sandwiching the wire seal 174, this spatial part 152 provides a space between a deep side of the spatial part 152 and a tip section of the enclosure 98 of the second housing 84. When connecting the first and second connector members 12, 68, the hood member 122 is pressed toward the second housing 84 so that the wire seal 174 is also compressed. The enclosure 98 of the second housing 84 is moved along a distance within the spatial part 152 yielded by the compression of the wire seal 174. Details will be described later.

Inside the hood member 122, a side closer to one side face 166 is formed with the fitting unit-guiding groove 168 configured to guide the outer guided part 56 formed in the first housing 22.

Figure 9A:
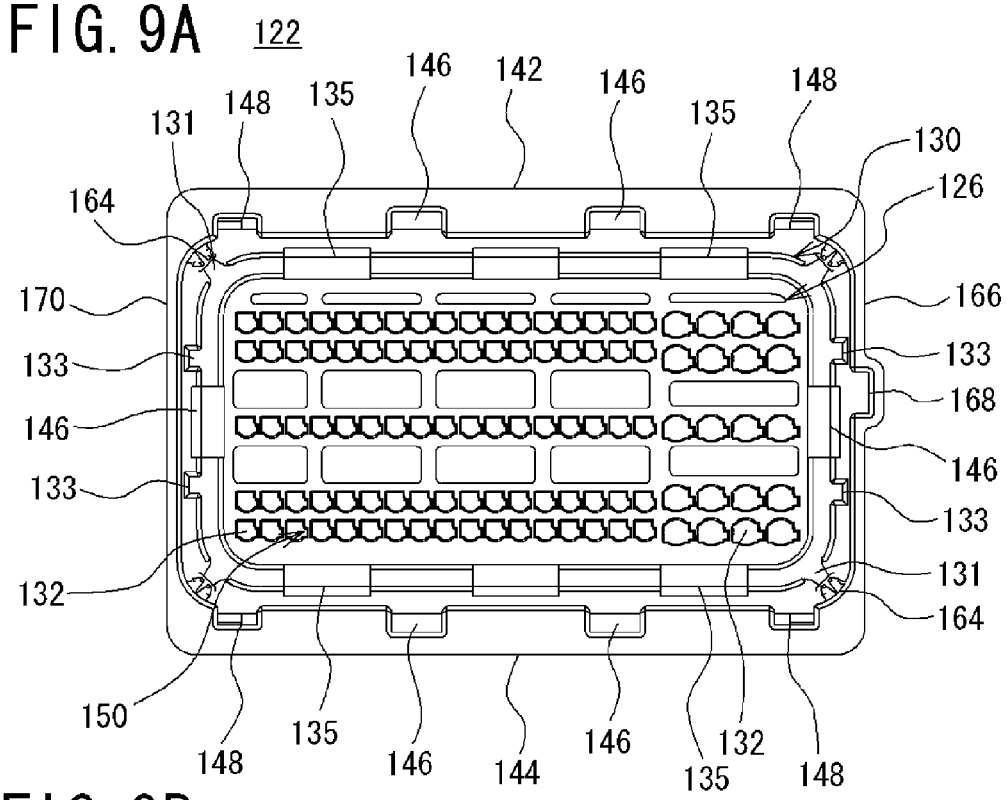
FIG. 9A is a front view of the hood member.
Figure 9B:
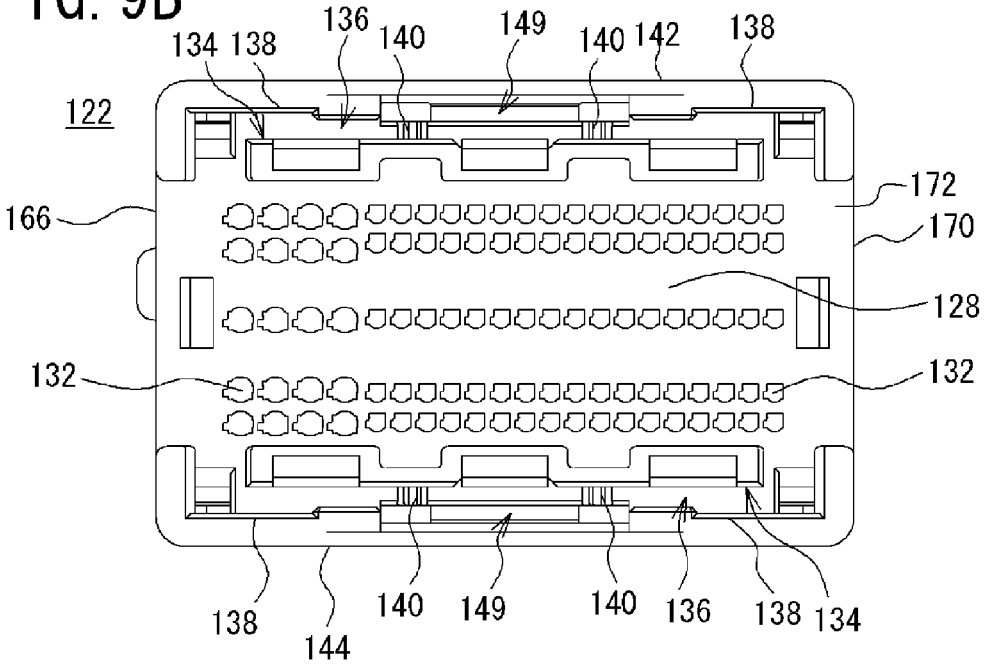
FIG. 9B is a rear view of the hood member.
Figure 10A:
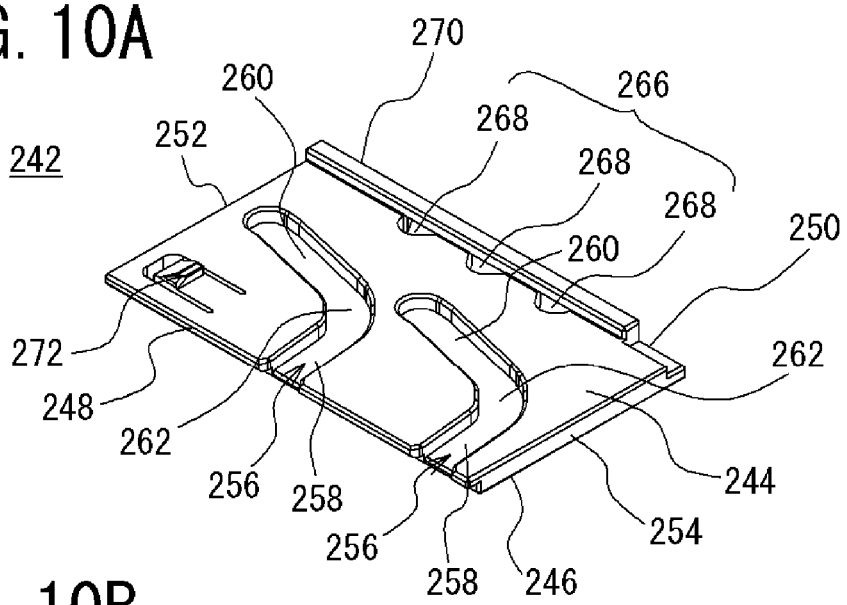
FIG. 10A is a perspective view of a slide member.
Figure 10B:
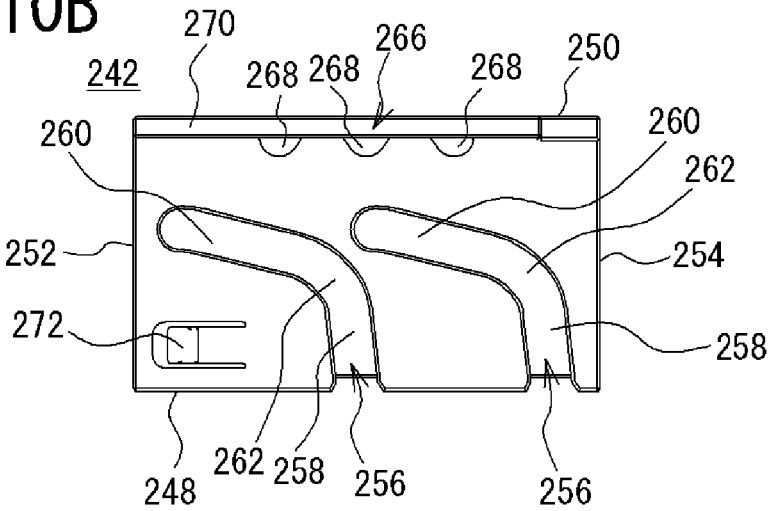
FIG. 10B is a plan view of the slide member.
Figure 10C:
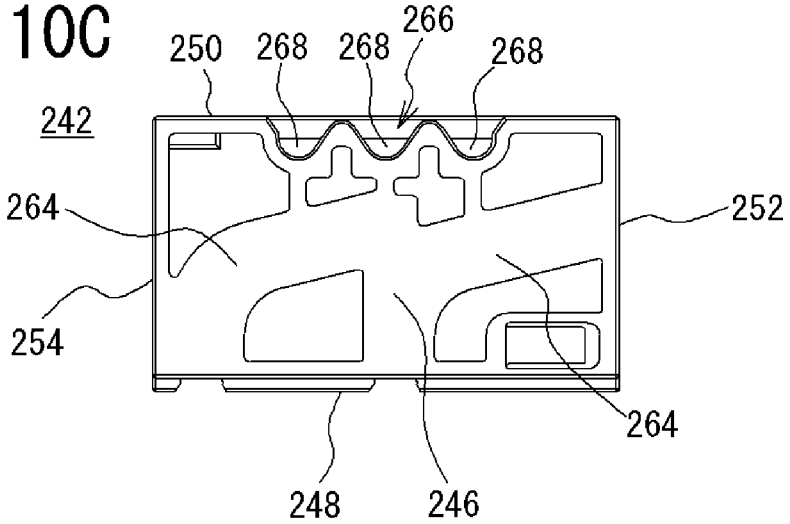
FIG. 10C is a bottom view of the slide member.
Figure 11A:
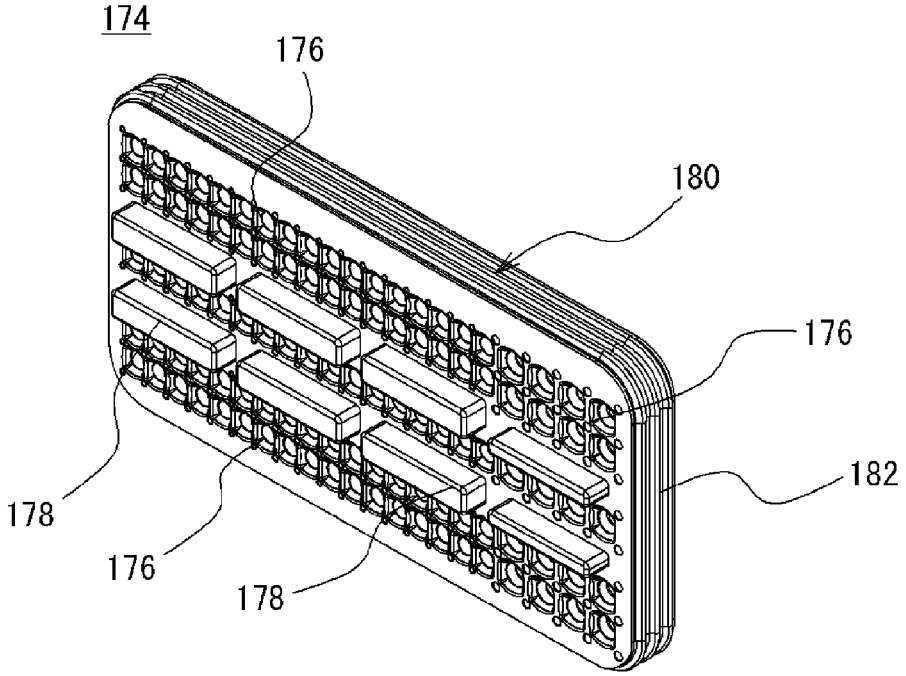
FIG. 11A is a perspective view of a wire seal seen from one side.
Figure 11B:
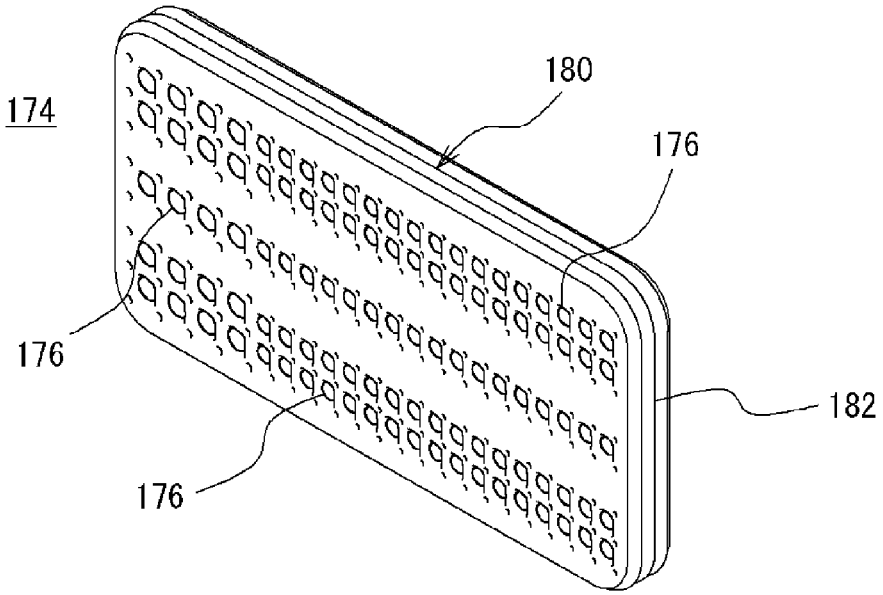
FIG. 11B is a perspective view of the wire seal seen from the other side.
Figures 12A, 12B, 12C, 12D:
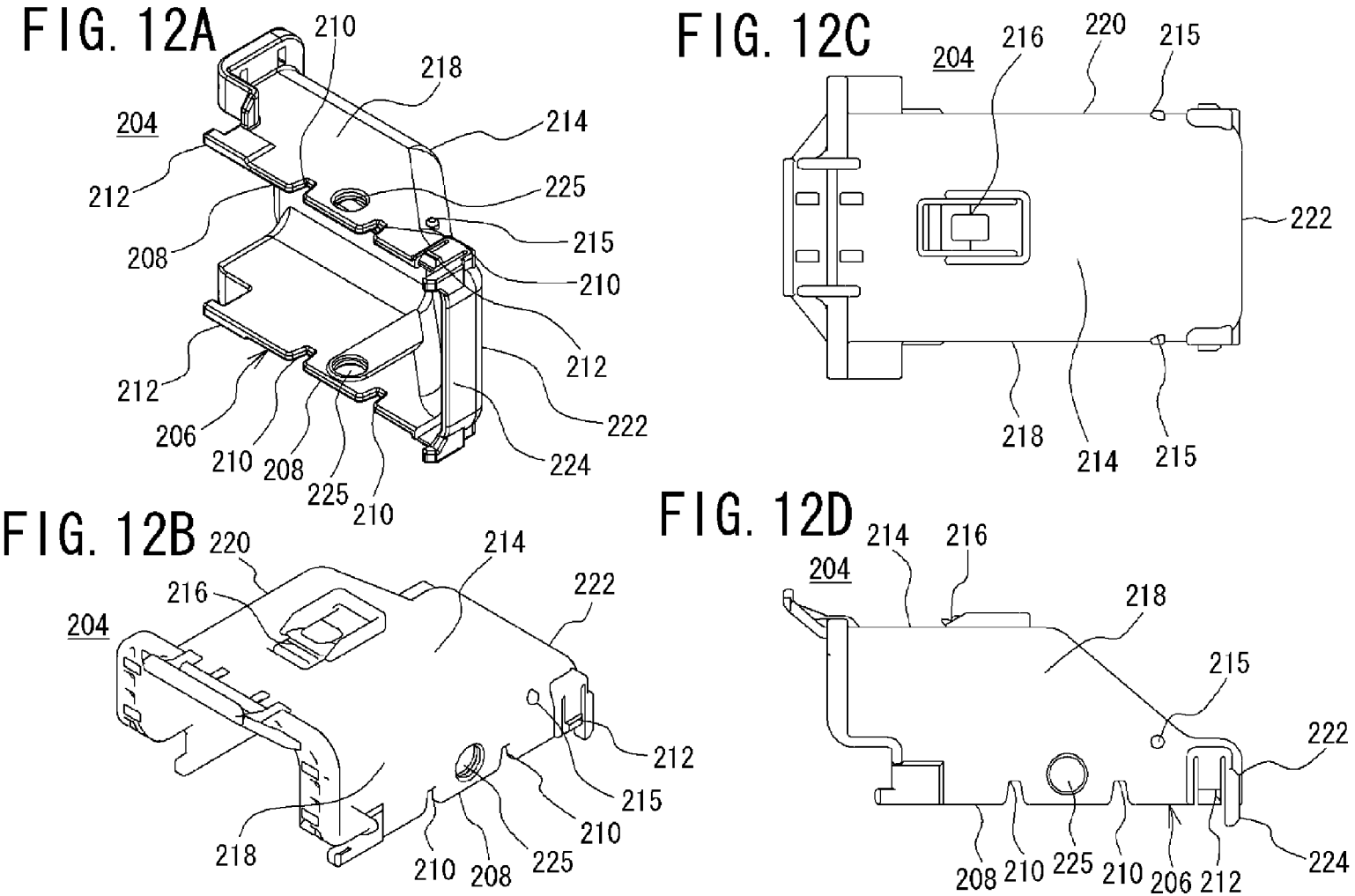
FIG. 12A is a perspective view of a cover member seen from one side.
FIG. 12B is a perspective view of the cover member seen from the other side.
FIG. 12C is a rear view of the cover member.
FIG. 12D is a plan view of the cover member.
Figure 16A:
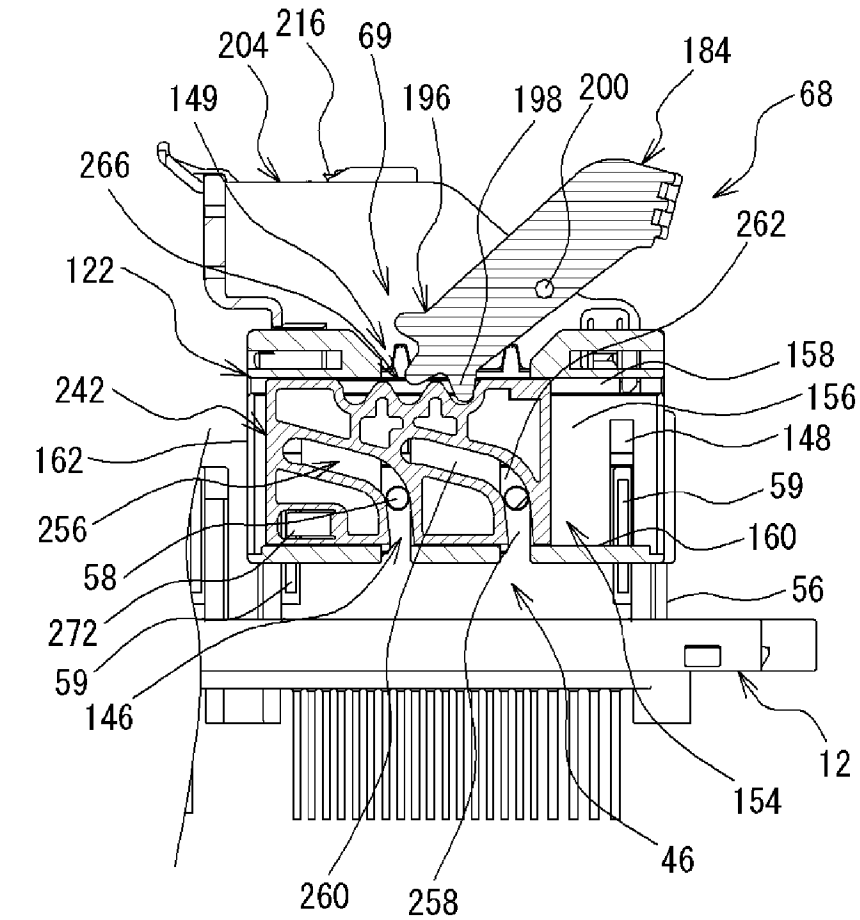
FIG. 16A is a cross sectional view taken along the line XVIA-XVIA in FIG. 15A.

As illustrated in FIGS. 9B and 16A, a plate body is provided inside the hood member 122 closer to each of the top and bottom faces 142, 144 so as to form a predetermined space. This space is a slide member-moving part 154 where the slide member 242 (to be mentioned) is to be disposed, being reciprocatingly movable. The plate body is a slide member-supporting unit 156 configured to slidably support the slide member 242.

This slide member-moving part 154 is substantially as wide as the top face 142 and bottom face 144 of the hood member 122 so that the slide member 242 can be moved from one side face 166 to the other side face 170 of the hood member 122. A part of the slide member-moving part 154 closer to the rear face 128 is formed with a slide rail groove 158 which a slide rail 270 formed in the slide member 242 (to be mentioned) is to be fitted with and to be moved along. A part of the slide member-moving part 154 closer to the front face 124 is formed with a slide member-supporting wall 160 configured to slidably support one long side 248 (see FIGS. 10A to 10C) of the slide member 242.

Furthermore, the slide member-supporting unit 156 is formed with passage grooves 146 through which the protrusions 58 formed in the first housing 22 are to pass. Guiding rail grooves 148 configured to guide the guided protrusions 59 formed in the fitting unit 46 of the first housing 22 are formed outside the passage grooves 146, that is, in parts closer to one side face 166 and to the other side face 170.

When connecting the first and second connector members 12, 68, note that the protrusions 58 of the fitting unit 46 of the first housing 22 passing through the passage grooves 146 are protruded from the slide member-supporting unit 156 toward the top and bottom faces 142, 144. Then, the protrusions 58 are engaged with slide grooves 256 (see FIGS. 10A, 10B, and 16A) formed in the slide member 242 (to be mentioned).

One of the guiding rail grooves 148 formed in the slide member-supporting unit 156 temporarily locks the inserted slide member 242. In the other words, in order not to move the slide member 242 inserted into the slide member-moving part 154 before fitting the first and second connector members 12, 68, the locking protrusive part 272 formed in the slide member 242 is to be locked temporarily in one of the guiding rail grooves 148. In connecting the first and second connector members 12, 68, when the guided protrusions 59 formed in the fitting unit 46 of the first housing 22 move along the guiding rail grooves 148, one of the guided protrusions 59 pushes up the locking protrusive part 272 of the slide member 242 locked in one of the guiding rail grooves 148 so that the locking protrusive part 272 of the slide member 242 releases the lock of the slide member 242.

In the rear face 128 of the hood member 122, a substantially central part of each side closer to the top and bottom faces 142, 144 is formed with a claw-shaped part-penetrated hole 149 which is to be penetrated by each claw-shaped part 196 of the lever member 184 (to be mentioned). These claw-shaped part-penetrated holes 149 are linked to the slide member-moving part 154 so that the claw-shaped parts 196 penetrating these claw-shaped part-penetrated holes 149 become rotatable in accordance with the rotation of the lever member 184. Furthermore, each claw-shaped part 196 is configured to match with an engaging groove 266 (see FIG. 16A) formed in the slide member 242.

In one and the other side faces 166, 170 of the hood member 122, each part closer to the top and bottom faces 142, 144 is formed with a slide member-inserted port 162 into which the slide member 242 is to be inserted.

The front face 124 of the hood member 122 is formed with the opening 126 into which the second housing 84 is to be inserted when assembling the second connector member 68. This opening 126 also performs as a part to be fitted with the fitting unit 46 of the first housing 22 when connected to the first connector member 12. Note that those parts of the front face 124 closer to the top face 142, bottom face 144, and one side face 166 are formed with grooves linked to the passage grooves 146, the guiding rail grooves 148, and the fitting unit-guiding groove 168 formed inside the hood member 122.

The rear face 128 of the hood member 122 is formed with a plurality of wire-penetrated holes 132 configured to be penetrated by the plurality of wires 78. The wire-penetrated holes 132 penetrate the rear face 128 from the front face 124. There are two types of wire-penetrated holes 132, that is, one for signals; and one for power source.

In the rear face 128 of the hood member 122, each part closer to the top and bottom faces 142, 144 is formed with a cover member-mounted part 134 which is to be mounted with the cover member 204 (to be mentioned). Each cover member-mounted part 134 is formed with a plane opening 136, and locked parts 138 (see FIGS. 11A and 11B). An inserting plate 208 formed in the cover member 204 is to be inserted into each plane opening 136. The locked parts 138 are configured to be locked in locking protrusions 212 of the cover member 204. Furthermore, each plane opening 136 is formed with partitions 140 with which slits 210 of the cover member 204 are to be fitted, positioned, and fixed. The slits 210 herein are formed by partially chipping the inserting plate 208 of the cover member 204.

The hood member 122 is provided with stages 172 disposed from the rear face 128 to one side face 166 and from the rear face 128 to the other side face 170. Each stage 172 is partially chipped and formed in a step-like shape. The stage 172 is to be fitted with a side wall 224 formed in the cover member 204. Note that the side wall 224 of the cover member 204 herein is configured to fit with the stage 172 disposed in one side face 166.

Next, the slide member 242 will be described with reference to FIGS. 10A, 10B, 10C, 16A, and 16B. In the second connector member 68 herein, a pair of slide members 242 is employed, provided to the top and bottom faces 142, 144 of the hood member 122. Note that these two slide members 242 are facing each other and are formed symmetrically. The slide member 242 provided to the bottom face 144 of the hood member 122 will be hereinafter described as an example.

The slide member 242 is formed of a resin material and includes, for example, a quadrilateral plate-like body having a predetermined area. The plate-like body includes a first surface 244 formed with two slide grooves 256; a second surface 246 formed with a bottom plate 264 configured to cover the slide grooves 256; a pair of long sides 248, 250 elongated along the moving direction of the slide member 242; and a pair of short sides 252, 254 stretching along the fitting direction.

The first surface 244 of the slide member 242 is formed with a pair of slide grooves 256. Each slide groove 256 is cut in from one long side 248 and substantially formed in an L-shape, having a vertical groove 258 slightly inclined along the short sides 252, 254; a horizontal groove 260 slightly inclined along the long sides 248, 250; and a curvilinear corner groove 262 linking these vertical and horizontal grooves 258, 260. When connecting the first and second connector members 12, 68, the protrusions 58 formed in the fitting unit 46 of the first housing 22 passes through these slide grooves 256. In the moving direction of the slide member 242 when connecting the first and second connector members 12, 68, note that each horizontal groove 260 is formed in such a manner that a part closer to one short side 252, or a rear side, is inclined to be closer to the other long side 250 than a part closer to the other short side 254, or a front side.

The first surface 244 of the slide member 242 is also formed with the locking protrusive part 272. When the slide member 242 is inserted into the slide member-moving part 154 of the hood member 122, the locking protrusive part 272 is locked with one of the guiding rail grooves 148 formed in the slide member-supporting unit 156 so that the slide member 242 is positioned and fixed inside the slide member-moving part 154 of the hood member 122.

In regard to the other long side 250 opposing one long side 248 formed with ports of the slide grooves 256 of the slide member 242, it is formed with the engaging groove 266 configured to match with the claw-shaped part 196 of the lever member 184 (to be mentioned). This engaging groove 266 includes curvilinear recesses and projections with a plurality of, herein three, recessed parts 268 recessed toward the inside of the slide member 242. Note that these recessed parts 268 are configured to match with claw members 198 of the claw-shaped part 196. Furthermore, the engaging groove 266 is cut from the first surface 244 to the second surface 246.

In the first surface 244, the other long side 250 with the engaging groove 266 is formed with the slide rail 270 protruded and elongated along the other long side 250. This slide rail 270 is fitted with the slide rail groove 158 formed in the slide member-supporting unit 156 of the hood member 122 and configured to guide the movement of the slide member 242.

Next, the wire seal 174 will be described with reference to FIGS. 5, 11A, 11B, 16A, and 16B. The wire seal 174 includes a plate-like body having a predetermined thickness and formed with a plurality of wire-penetrated parts 176 which is to be penetrated by the plurality of wires 78. Furthermore, the wire seal 174 is formed of an elastic member having elasticity such as rubber.

In a side to be connected to the second housing 84, the wire seal 174 is formed with a plurality of inserting protrusions 178 which is to be inserted into the wire seal-inserted grooves 96 formed in the second housing 84.

A periphery 180 of the wire seal 174 is formed with annular recesses and projections 182. The wire seal 174 is configured to be mounted on the hood member 122 together with the second housing 84 with being mounted on an inner part of the enclosure 98 closer to the second rear surface 92 of the second housing 84. On this occasion, the wire seal 174 is to be brought into contact with the wire seal-contacted surface 150 disposed inside the rear face 128 of the hood member 122. Therefore, the wire seal 174 is configured to be sandwiched between the wire seal-contacted surface 150 inside the hood member 122 and the second rear surface 92 of the second housing 84.

Next, the cover member 204 will be described with reference to FIGS. 12A to 12D. The cover member 204 is to be mounted on the rear face 128 of the hood member 122 and is configured to form a passage for guiding the plurality of penetrated wires 78.

A mounting surface 206 of the cover member 204 which is to be mounted on the hood member 122 is opened. Furthermore, the cover member 204 is formed in such a manner that the passage for guiding the wires 78 introduced from the mounting surface 206 is formed toward a substantially perpendicular direction with respect to the fitting direction of the first and second connector members 12, 68. A guiding wall surface 214 disposed in an opposite side of the mounting surface 206 is partially inclined. A cover top surface 218, a cover bottom surface 220, and a cover side surface 222 surround the cover member 204 so as to link the mounting surface 206 and the guiding wall surface 214. An opposite side of the cover side surface 222 is opened so that the wires 78 can be put out.

In regard to the mounting surface 206 of the cover member 204, each side closer to the cover top and cover bottom surfaces 218, 220 is formed with the locking protrusions 212, and the inserting plate 208 which is to be mounted on the cover member-mounted part 134 formed in the rear face 128 of the hood member 122. Each inserting plate 208 is formed in a plate-like shape disposed along the cover top and cover bottom surfaces 218, 220 of the mounting surface 206. Furthermore, each inserting plate 208 is formed with the locking protrusions 212 disposed in both parts closer to the cover side surface 222 and to the opposite side of the cover side surface 222. Note that each inserting plate 208 is formed with a plurality of slits 210 configured to match with the partitions 140 formed in the cover member-mounted part 134 of the hood member 122.

In regard to the cover top and cover bottom surfaces 218, 220 of the cover member 204, each surface is formed with a stopping protrusion 215 configured to temporarily stop the lever member 184.

The cover side surface 222 of the cover member 204 is formed with the side wall 224 stretching toward the hood member 122.

Furthermore, a protrusive lock 216 is formed outside the guiding wall surface 214 of the cover member 204. The protrusive lock 216 is configured to fix a lock unit 190 (see FIGS. 13A, 13B, 16A, and 16B) of the lever member 184 (to be mentioned).

Each of the cover top and cover bottom surfaces 218, 220 of the cover member 204 is also formed with a bearing 225 penetrating toward the mounting surface 206. Each shaft 194 (see FIGS. 13A and 13B) formed in the lever member 184 is to be rotatably mounted on each bearing 225. Note that the lever member 184 will be mounted on the cover member 204 by inserting the shafts 194 of the lever member 184 into the bearings 225 from the cover top surface 218 and from the cover bottom surface 220 of the cover member 204.

The cover member 204 will be mounted on the hood member 122 by the following process. First, the lever member 184 is mounted on the cover member 204. Then, the inserting plates 208 of the mounting surface 206 of the cover member 204 are inserted into the plane openings 136 of the cover member-mounted part 134 of the hood member 122. On this occasion, the slits 210 in the inserting plates 208 are inserted into the partitions 140 formed inside the plane openings 136. Furthermore, the claw-shaped parts 196 of the lever member 184 penetrate the claw-shaped part-penetrated holes 149 of the hood member 122. Finally, the locked parts 138 formed in the cover member-mounted part 134 of the hood member 122 are locked with the locking protrusions 212 of the cover member 204, thereby completing the mounting of the cover member 204 on the hood member 122. On this occasion, each claw-shaped part 196 of the lever member 184 is configured to match with the engaging groove 266 of the slide member 242 inserted in advance into the slide member-moving part 154 of the hood member 122.

Figure 13A:
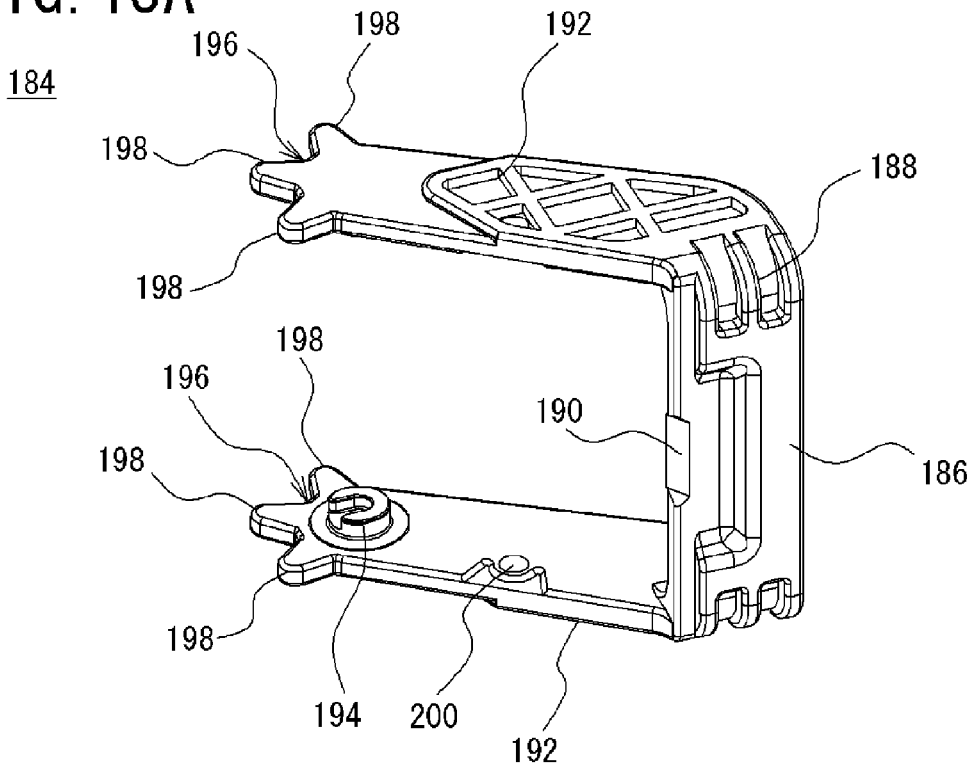
FIG. 13A is a perspective view of a lever member.
Figure 13B:
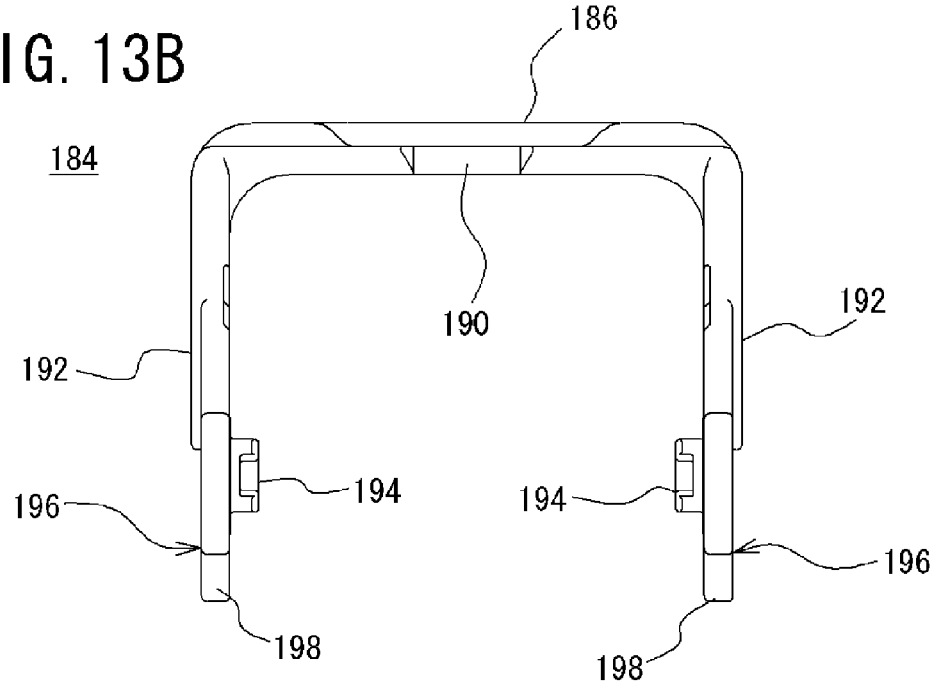
FIG. 13B is a front view of the lever member.

Next, the lever member 184 will be described with reference to FIGS. 13A and 13B. The lever member 184 is formed of a resin material, including: an operation part 186 having a predetermined length; a pair of arms 192 opposing each other, stretching from both sides of the operation part 186; the claw-shaped parts 196 each provided with a plurality of claw members 198 radially stretching from one end of each arm 192; and the shafts 194 protruded from inner sides of the claw-shaped parts 196, that is, from both sides where the claw-shaped parts 196 face each other.

The operation part 186 is used when a user operates the lever member 184. For example, in a surface of the operation part 186 opposing the side from which the arms 192 are stretching, a plurality of recessed and projected grooves 188 is formed to avoid slipping.

Furthermore, in a side end of the surface on which the recessed and projected grooves 188 of the operation part 186 are formed, the lock unit 190 is formed. When connecting the first and second connector members 12, 68, this lock unit 190 is locked and fixed with the protrusive lock 216 (see FIGS. 12A to 12D, and FIGS. 16A and 16B) formed in the cover member 204.

The arms 192 are a pair of plates having a predetermined length. When the lever member 184 rotates, the arms 192 move along the cover top and cover bottom surfaces 218, 220 of the cover member 204. A stopping hole 200 is formed in an inner side of each arm 192. The stopping hole 200 is to be fitted with the stopping protrusion 215 formed in each of the cover top and cover bottom surfaces 218, 220 of the cover member 204.

Each claw-shaped part 196 includes the plurality of, herein three, claw members 198 radially protruded from one end of each arm 192. Matched with the engaging groove 266 formed in the slide member 242, each claw-shaped part 196 can move the slide member 242 in accordance with the rotation of the lever member 184.

Each shaft 194 is formed in a substantially circular pillared shape, protruded from a substantially central portion of the claw-shaped part 196 in one end of each arm 192 toward a substantially perpendicular direction. Each shaft 194 is mounted on the bearing 225 formed in the cover member 204 so that lever member 184 can be rotated. Herein, note that each shaft 194 is formed with an indentation.

Figure 14A:
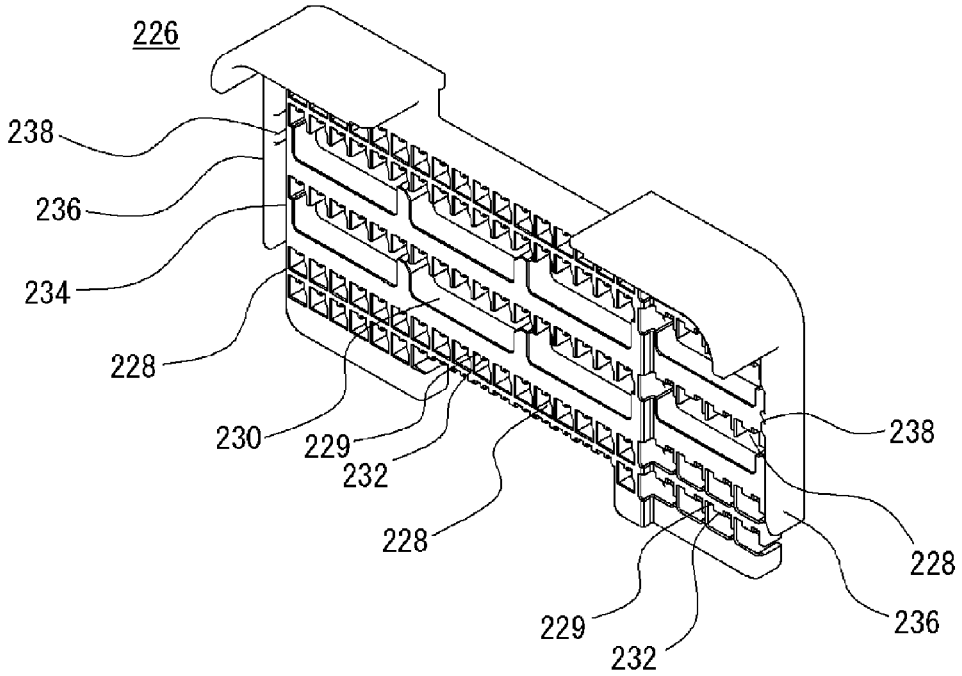
FIG. 14A is a perspective view of a retainer.
Figure 14B:
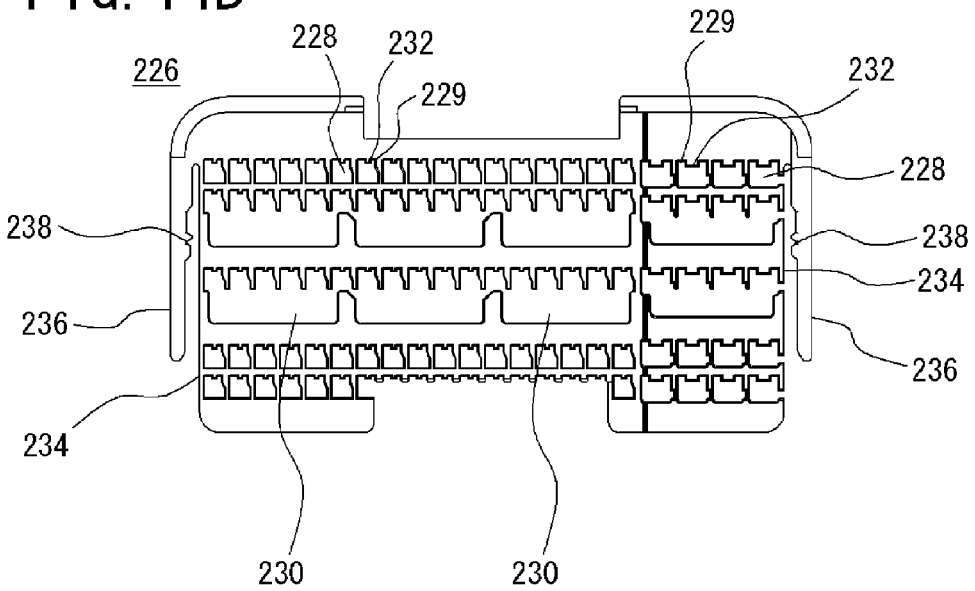
FIG. 14B is a front view of the retainer.
Figure 15A:
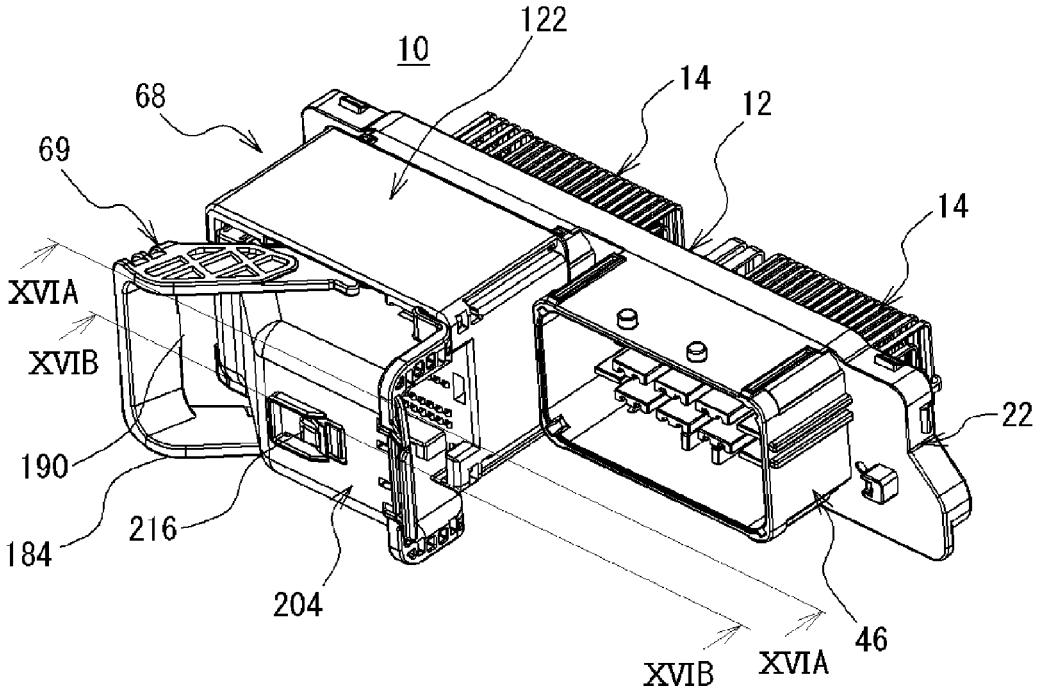
FIG. 15A is a perspective view following FIG. 1B, explaining connection between the first and second connector members.
Figure 15B:
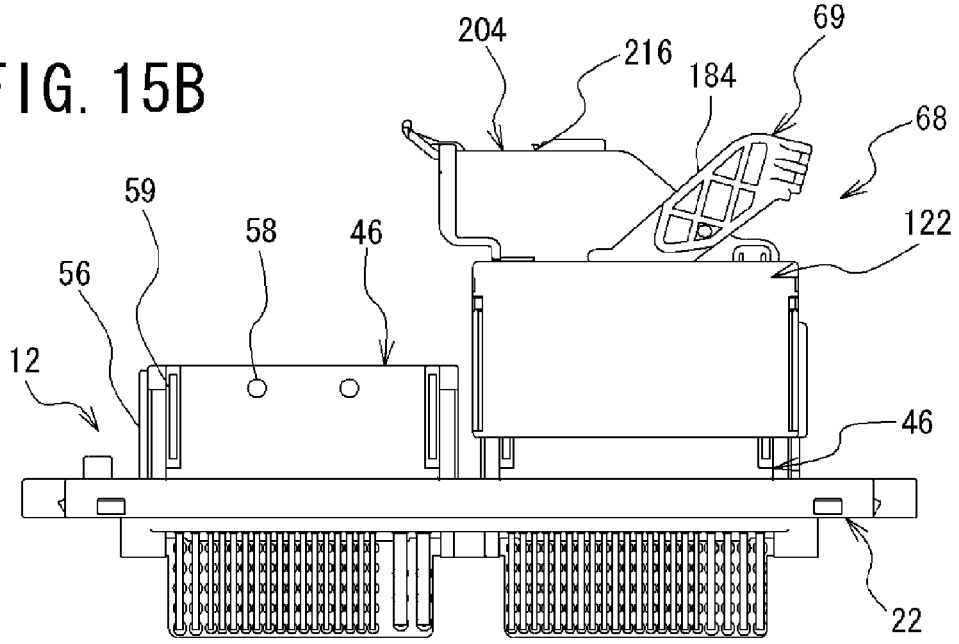
FIG. 15B is a plan view explaining connection between the first and second connector members.

Next, the retainer 226 will be described with reference to FIGS. 14A and 14B. The retainer 226 includes a plate-like body having a predetermined thickness. The retainer 226 is formed with contact-penetrated holes 228 to be penetrated by the plurality of second contacts 70; and a plurality of guided plate-penetrated holes 230 to be penetrated by the guided plates 60 formed in the first housing 22 of the first connector member 12.

A fixing protrusion 232 is formed in an upper part 229 of each contact-penetrated hole 228. Each fixing protrusion 232 is to be fitted with the fixed part 83 formed in each second contact 70.

A pair of mounting members 236 is formed in both side parts 234, 234 of the retainer 226. An inner part of each mounting member 236 is formed with a rib-for-locking 238 to be locked with the retainer-locking protrusion 118 (see FIGS. 7A and 7B) formed in each of one and the other second side surfaces 114, 116 of the second housing 84.

Before equipping the second housing 84 with the second contacts 70, the retainer 226 is inserted into the retainer-equipped groove 110. After containing the second contacts 70 in the second contact-containing unit 120 of the second housing 84, the retainer 226 is pressed so that the fixing protrusions 232 of the retainer 226 are fitted with the fixed parts 83 formed in the second contacts 70 and that the second contacts 70 are positioned and fixed.

As illustrated in FIGS. 5, 16A and 16B, the seal member 240 is formed in an annular shape by an elastic member having elasticity such as rubber. The seal member 240 is to be mounted on a seal member-equipped part 121 (see FIGS.

7A and 7B) in the periphery of the second housing 84. When connecting the first and second connector members 12, 68, the seal member 240 is stuck fast inside the fitting unit 46 of the first housing 22 so as to perform as a waterproof member.

Next, the connection between the first and second connector members 12, 68 will be described with reference to FIGS. 1A, 1B, and 15A to 19B.

The first and second connector members 12, 68 will be connected in the following process. First, as illustrated in FIG. 1B, the first and second connector members 12, 68 which are to be connected are disposed, corresponding to each other. On this occasion, the outer guided part 56 formed in one side 50, closer to one side surface, of the fitting unit 46 of the first housing 22 of the first connector member 12 is disposed so as to correspond with the fitting unit-guiding groove 168 formed in one side face 166 of the hood member 122 of the second connector member 68. In such manners, the reverse connection of the second connector member 68 can be avoided.

Next, as illustrated in FIGS. 15A to 16B, the second connector member 68 is inserted into the fitting unit 46 of the first connector member 12. On this occasion, the fitting unit 46 of the first connector member 12 is inserted into the space 173 between the second housing 84 of the second connector member 68 and the hood member 122. Furthermore, in this insertion, a plurality of inner guided parts 54 formed in inner parts of the sides 48, 52 of the fitting unit 46 closer to the top and bottom surfaces is introduced to the guiding grooves 108 formed in the second top, and second bottom surfaces 106, 112 of the second housing 84. Furthermore, the first contacts 14 protruded from the first front surface 26 of the first housing body 24 inside the fitting unit 46 and the guided plates 60 formed in the first front surface 26 are respectively inserted into the first contact-inserted parts 88 and guiding holes 90 formed in the second front surface 86 of the second housing 84. After inserted from the first contact-inserted parts 88 of the second housing 84, note that the first contacts 14 are brought into contact with the second contacts 70 contained in the second contact-containing unit 120 of the second housing 84.

Furthermore, in this insertion, the outer guided part 56 formed in the periphery of one side 50 of the fitting unit 46 closer to one side surface is guided to the fitting unit-guiding groove 168 formed inside the other side face 166 of the hood member 122 of the second connector member 68.

Each of the guided protrusions 59 formed in the periphery of the sides 48, 52 of the fitting unit 46 closer to the top and bottom surfaces is moved along each of the guiding rail grooves 148 formed inside the top face 142 and bottom face 144 of the hood member 122. On this occasion, the locking protrusive part 272 formed in the slide member 242, locked in the guiding rail groove 148 is pressed on the guided protrusion 59 moving along the guiding rail groove 148 so that the lock of the locking protrusive part 272 is released and the slide member 242 can be moved.

Furthermore, each of the protrusions 58 formed in the sides 48, 52 of the fitting unit 46 closer to the top and bottom surfaces passes through each of the passage grooves 146 formed inside the top face 142 and bottom face 144 of the slide member-supporting unit 156 of the hood member 122. On this occasion, each protrusion 58 is inserted into each slide groove 256 formed in the slide member 242 provided to the slide member-moving part 154 of the hood member 122. Note that each protrusion 58 of the fitting unit 46 passing through the vertical groove 258 stretching along the fitting direction of the slide groove 256 of the slide member 242 is disposed before the corner groove 262.

As illustrated in FIG. 16B, the tip section of the enclosure 98 formed in the second rear surface 92 of the second housing 84, that is, a side in the fitting direction is inserted into the spatial part 152 formed in the periphery of the wire seal-contacted surface 150 inside the rear face 128 of the hood member 122. On this occasion, the tip section of the enclosure 98 and the deep side of the spatial part 152 are not brought into contact with each other so as to provide a space therebetween. Note that when the lever member 184 is not operated, there is no compression applied to the wire seal 174.

Figure 17B:
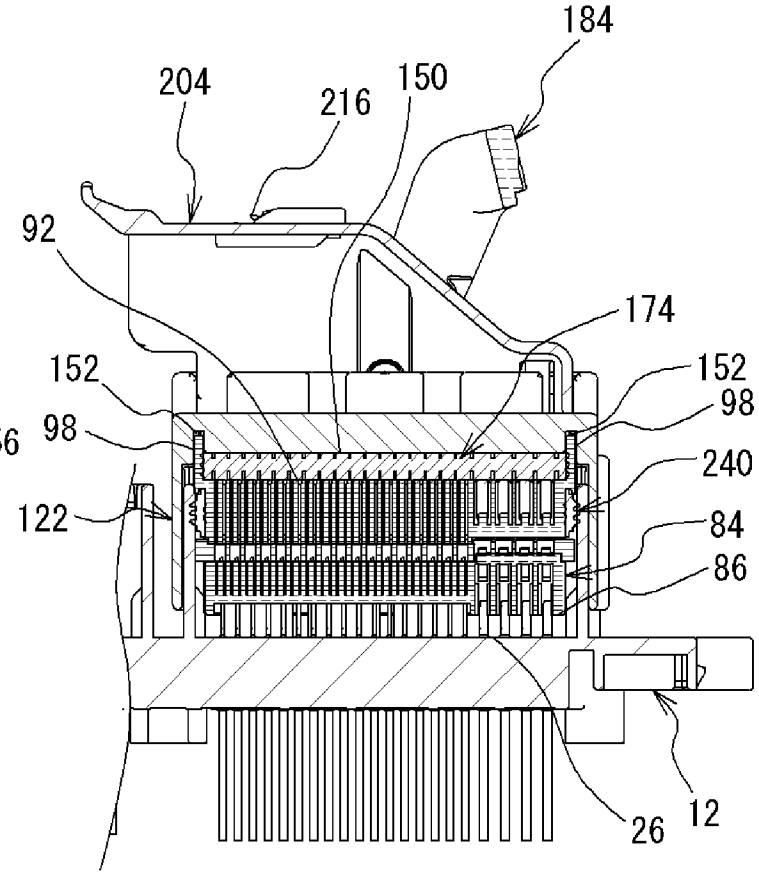
FIG. 17B is a cross sectional view following FIG. 16B.
Figure 17A:
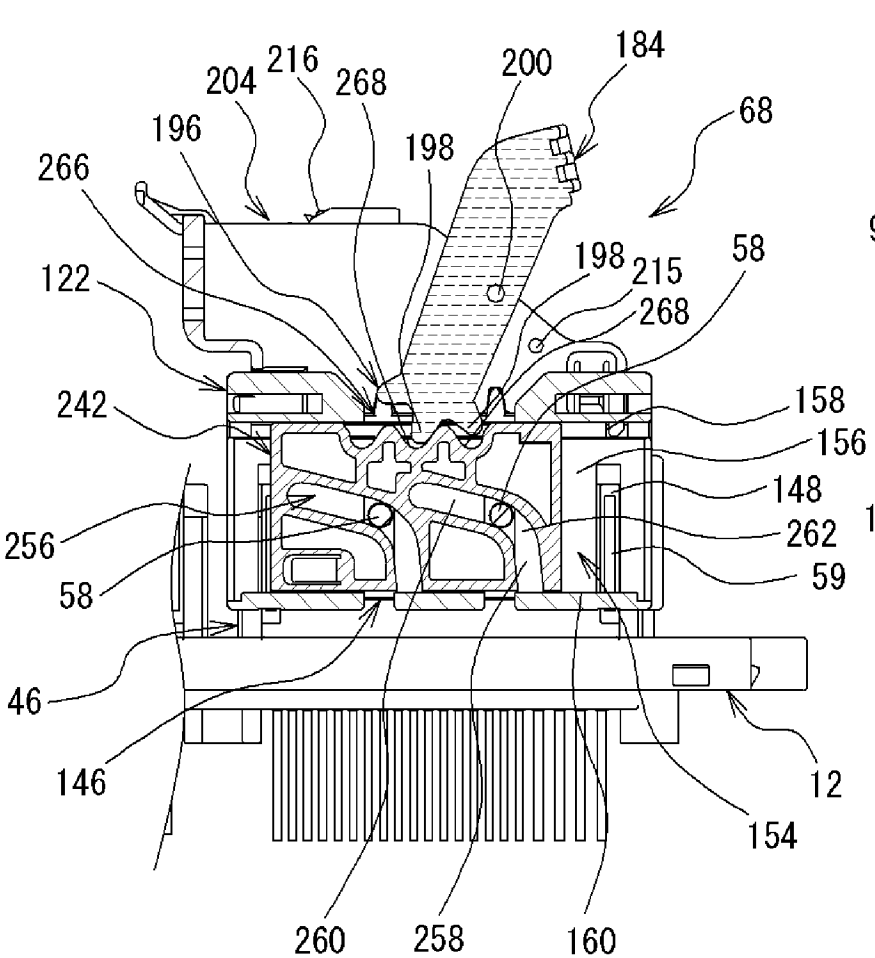
FIG. 17A is a cross sectional view following FIG. 16A, explaining the connection between the first and second connector members.

Next, as illustrated in FIGS. 17A and 17B, the lever member 184 of the second connector member 68 is rotated. Rotated around the shaft 194, the lever member 184 is rotated while the claw members 198 of the claw-shaped part 196 of the lever member 184 and the recessed part 268 of the engaging groove 266 of the slide member 242 are matched with each other. Accordingly, when FIG. 17A is seen from a plan view, the slide member 242 is moved along the slide member-moving part 154 in a rightward direction, that is, a direction in which the protrusions 58 of the fitting unit 46 are separated from the vertical grooves 258 of the slide grooves 256. On this occasion, each protrusion 58 of the fitting unit 46 is moved along the inside of each slide groove 256 of the slide member 242, from the corner groove 262 to the horizontal groove 260 inclined in the substantially perpendicular direction with respect to the fitting direction. Furthermore, the slide member 242 is moved in such a manner that the slide rail 270 and one long side 248 of the slide member 242 are moved along the slide rail groove 158 and the slide member-supporting wall 160 of the slide member-moving part 154.

Since the horizontal groove 260 of each slide groove 256 is slightly inclined, when each protrusion 58 of the fitting unit 46 is introduced into this inclined horizontal groove 260 together with the movement of the slide member 242, the second connector member 68 is moved in a direction approaching the first connector member 12, that is, in the fitting direction.

As illustrated in FIG. 17B, as the second connector member 68 approaches the first connector member 12, the enclosure 98 formed in the second rear surface 92 of the second housing 84 is fitted into the spatial part 152 formed in the periphery of the wire seal-contacted surface 150 inside the rear face 128 of the hood member 122. On this occasion, the wire seal 174 is configured to be sandwiched between the second rear surface 92 of the second housing 84 and the wire seal-contacted surface 150 of the hood member 122 so as to be gradually compressed by them. Even in such a case, the tip section of the enclosure 98 and the deep side of the spatial part 152 are not brought into contact with each other and provide a space therebetween.

Figure 18B:
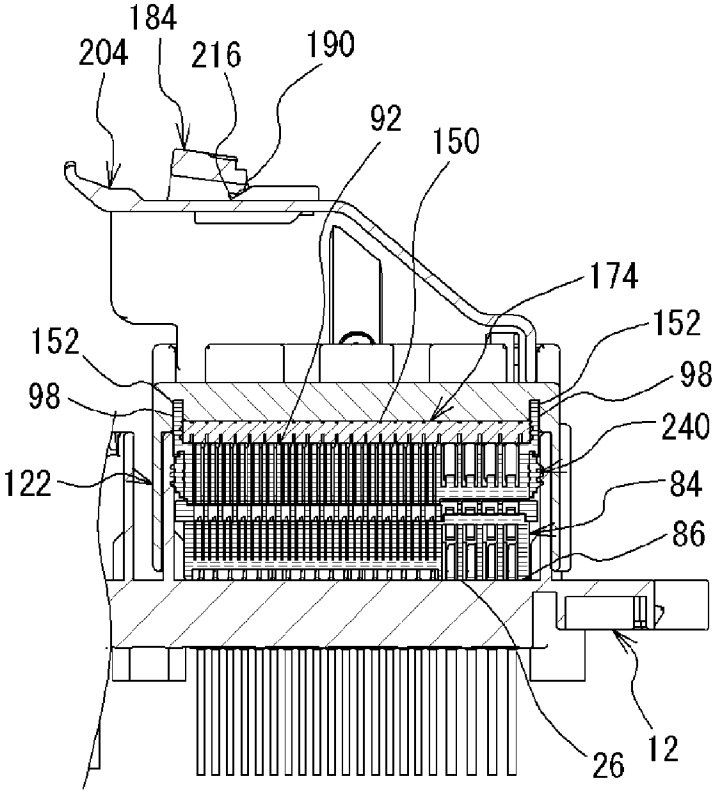
FIG. 18B is a cross sectional view following FIG. 17B.
Figure 18A:
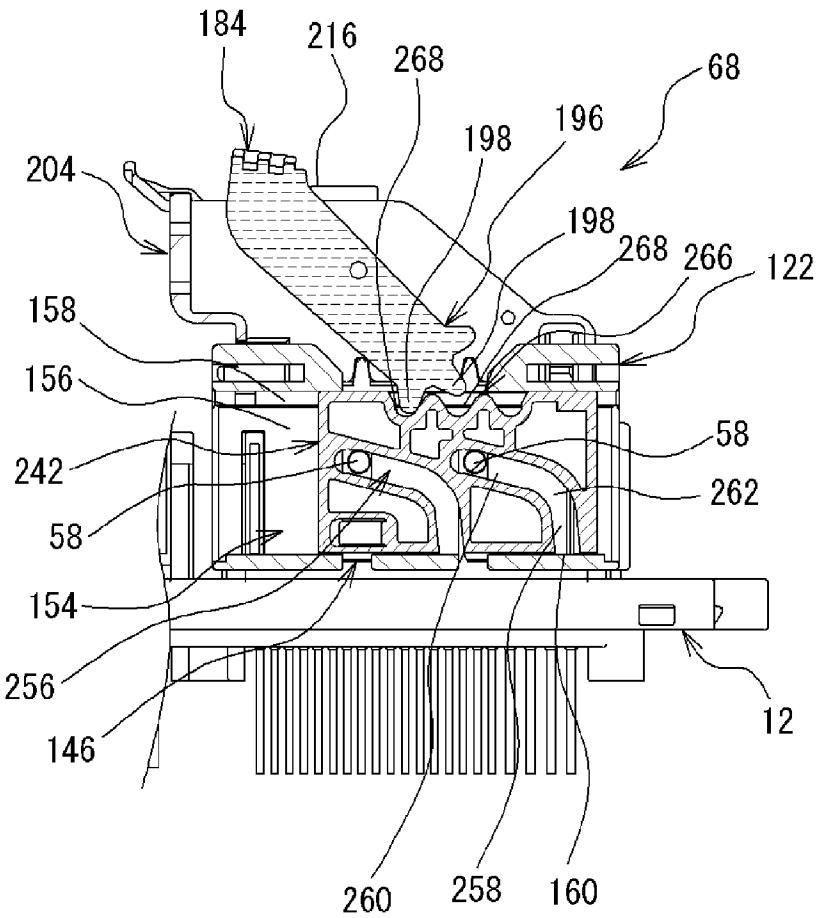
FIG. 18A is a cross sectional view following FIG. 17A, explaining the connection between the first and second connector members.

Afterwards, as illustrated in FIG. 18A, the lever member 184 is further rotated, and the slide member 242 is further moved in rightward direction, and each protrusion 58 of the fitting unit 46 is pressed on the inclined horizontal groove 260 of each slide groove 256 of the slide member 242. Accordingly, the second connector member 68 is further moved in the direction approaching the first connector member 12. On this occasion, as illustrated in FIG. 18B, the second front surface 86 of the second housing 84 of the second connector member 68 is brought into contact with the first front surface 26 of the first housing 22 of the first connector member 12 so that the movement in the fitting direction is restrained. The enclosure 98 formed in the second rear surface 92 of the second housing 84 is further fitted into the deep side of the spatial part 152 formed in the periphery of the wire seal-contacted surface 150 inside the rear face 128 of the hood member 122.

As illustrated in FIG. 18B, the wire seal 174 is sandwiched between the second rear surface 92 of the second housing 84 and the wire seal-contacted surface 150 of the hood member 122 so that the wire seal 174 is compressed further.

In regard to the lever member 184, in a state where the second housing 84 and the first housing 22 are brought into contact with each other, a small distance is provided between the lock unit 190 of the lever member 184 and the protrusive lock 216 of the cover member 204 so that the lever member 184 is not fixed.

Figure 19B:
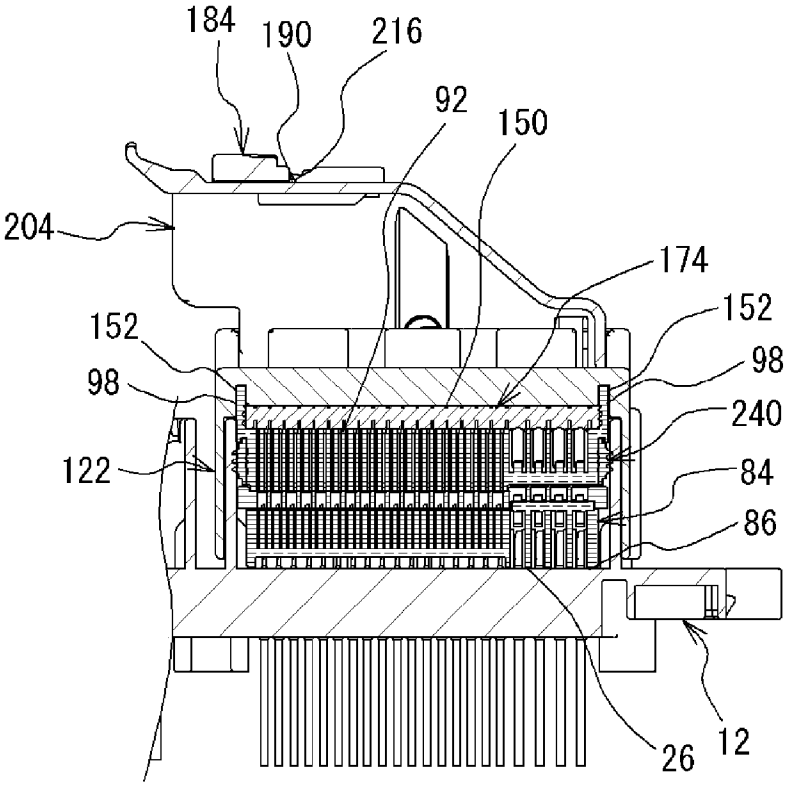
FIG. 19B is a cross sectional view following FIG. 18B.
Figure 19A:
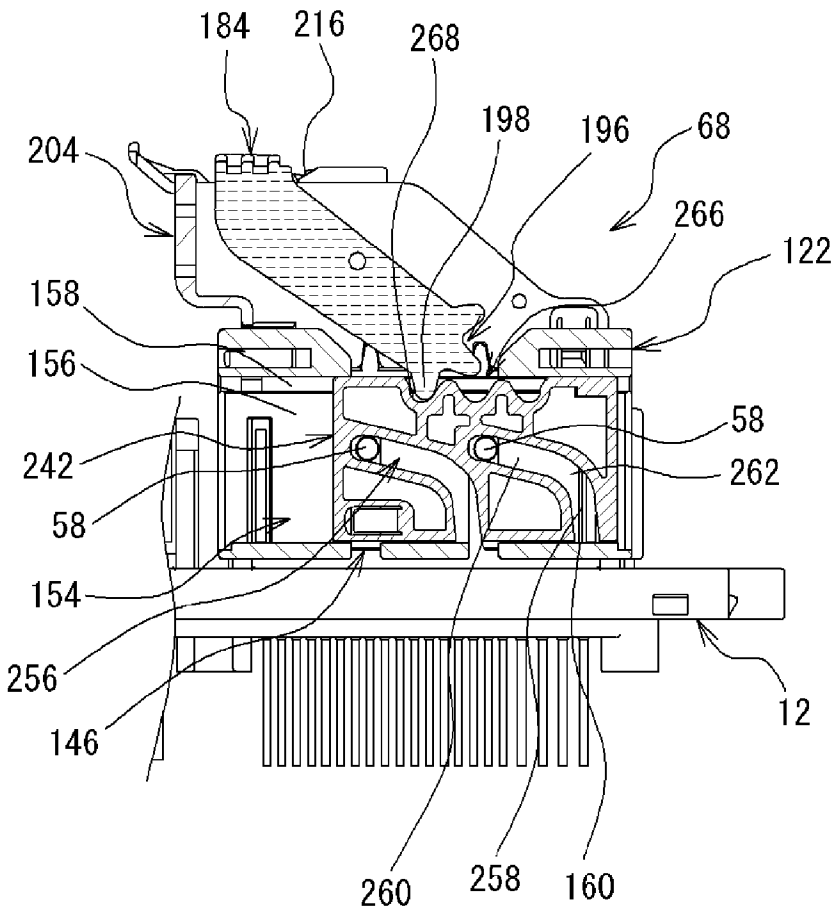
FIG. 19A is a cross sectional view following FIG. 18A, explaining the connection between the first and second connector members.

Afterwards, as illustrated in FIGS. 19A and 19B, the lever member 184 is further rotated so that the protrusive lock 216 of the cover member 204 is locked and fixed with the lock unit 190 of the lever member 184.

Due to the rotation of this lever member 184, the slide member 242 is further moved in the rightward direction so that each protrusion 58 of the fitting unit 46 is pressed on the inclined horizontal groove 260 of each slide groove 256 of the slide member 242, which causes pressure in the fitting direction on the first and second connector members 12, 68. However, the second housing 84 of the second connector member 68 and the first housing 22 of the first connector member 12 are brought into contact with each other, and the movement of the second housing 84 is restrained so that the wire seal 174 is compressed and the hood member 122 is moved. A distance along which the hood member 122 is moved is a distance in which the wire seal 174 between the second housing 84 and hood member 122 is compressed.

In regard to the tip section of the enclosure 98 formed in the second rear surface 92 of the second housing 84 and the deep side of the spatial part 152 formed in the periphery of the wire seal-contacted surface 150 inside the rear face 128 of the hood member 122, they are disposed to be the closest. On this occasion, the tip section of the enclosure 98 of the second housing 84 and the deep side of the spatial part 152 of the hood member 122 may be brought into contact with each other.

As mentioned above, according to the connector 10 herein, the wire seal 174 provided between the second housing 84 of the second connector member 68 and the hood member 122 is configured to be compressed. Therefore, in a status where the first and second connector members 12, 68 are fixed due to the elasticity of the wire seal 174 compressed between the second housing 84 and hood member 122, the second housing 84 can be constantly pressed toward the first housing 22. Thus, it is possible to restrain wobbles and to achieve high vibration resistance.

Furthermore, as the wire seal 174 is compressed, the wire-penetrated parts 176 penetrated by the wires 78 are also compressed so that a hole diameter of each wire-penetrated part 176 is decreased. Therefore, it is possible to enhance a water proofing property.

Note that the connection between the first contacts 14 provided to the first connector member 12 herein and the second contacts 70 provided to the second connector member 68 herein is to be carried out by the first contacting parts 18 (18*a*, 18*b*) of the first contacts 14 being gradually inserted into the second contacted parts 74 (74*a*, 74*b*) of the second contacts 70 in accordance with the connection between the first and second connector members 12, 68.

Accordingly, the connection between the first and second connector members 12, 68 is completed. Note that the connection between the first and second connector members 12, 68 can be easily released by taking off the lock unit 190 of the lever member 184 from the protrusive lock 216 of the cover member 204 and by rotating the lever member 184 reversely.

Herein, the locking mechanism 69 has been described that it includes the slide member 242 locked with the protrusions 58 of the first housing 22; and the lever member 184 configured to move the slide member 242, but it should not be restricted thereto. A lever member may be configured to lock protrusions and the protrusions may be introduced by rotating the lever member so as to move first and second connector members in the fitting direction.

Furthermore, the lever member 184 herein has been illustrated that it is formed of a resin material, but it should not be restricted thereto. For example, a lever member may be formed of a metallic material.

What is claimed is:

1. A connector comprising:

a first connector member; and a second connector member, wherein the first connector member and the second connector member are configured to be fitted with each other, and the first connector member includes a first housing formed with at least one protrusion disposed in a periphery of the first housing, and the second connector member includes a second housing; a hood member; an elastic member; and a locking mechanism, wherein the hood member is configured to cover the second housing and to be mounted with the second housing inside the hood member, and the elastic member is configured to be provided between the hood member and the second housing, and the locking mechanism is configured to lock the protrusion of the first connector member, wherein when connecting the first connector member and the second connector member, the locking mechanism is operated so that the protrusion of the first housing locked in the locking mechanism is drawn in a fitting direction, and the first connector member and the second connector member are moved in the fitting direction, and the first housing and the second housing are at least partially brought into contact with each other, and wherein after the movement of the first connector member and the second connector member in the fitting direction is restrained, the locking mechanism is operated further so that the hood member is moved in the fitting direction while the hood member compresses the elastic member provided between the hood member and the second housing, and the locking mechanism is fixed in a state where the elastic member is compressed.

2. The connector according to claim 1, wherein the second connector member includes at least one second contact configured to be brought into contact with at least one first contact provided to the first connector member, wherein the second contact includes a wire configured to be mounted on a side opposite to a side where the second contact is brought into contact with the first contact, and wherein the elastic member is formed with a part configured to be penetrated by the wire.

3. The connector according to claim 1, wherein the second housing is formed with an enclosure having a tubular shape and configured to contain the elastic member, the enclosure being disposed in a side of the second housing closer to the hood member, wherein the hood member is formed with a spatial part into which the enclosure is to be inserted, the spatial part being disposed in a side of the hood member closer to the second housing, and wherein in connecting the first connector member and the second connector member, when the hood member is moved while compressing the elastic member due to operation of the locking mechanism, the enclosure of the second housing is moved along the spatial part of the hood member.

4. The connector according to claim 1, wherein the locking mechanism includes:

slide members each having a plate-like shape and formed with at least one slide groove which the protrusion is configured to pass through, the slide members being disposed inside the hood member in such a manner that the slide members face each other; and a lever member configured to move the slide member, wherein the slide members are provided inside the hood member in such a manner that the slide members are to be moved reciprocatingly by the lever member in a direction perpendicular to the fitting direction of the first connector member and the second connector member, and wherein when connecting the first connector member and the second connector member, the lever member moves the slide member so that the protrusion is pressed while passing through the slide groove, and the first connector member and the second connector member are moved in the fitting direction.

5. The connector according to claim 4, wherein the slide groove has a width allowing the protrusions to pass therethrough, and the slide groove is formed in such a manner that a rear side is inclined further than a front side so that the rear part is apart from a side which is to be connected to the first connector member in a moving direction of the slide member when connecting the first connector member and the second connector member.

6. The connector according to claim 4, wherein the lever member includes:

an operation part;

a pair of arms stretching from both ends of the operation part;

a claw-shaped part formed with a plurality of protrusions and disposed in an end of each arm opposite to the operation part; and a shaft formed in a central part of the claw-shaped part, wherein each of the slide members is formed with an engaging part configured to be matched with the claw-shaped part, and the slide members are configured to be moved by rotating the lever member around the shaft.

7. The connector according to claim 1, wherein the first housing and the hood member are formed with at least one vibration-resistant protrusion or at least one vibration-resistant protrusion-inserted groove disposed in parts which are to be adjacent to each other when the first housing is fitted with the hood member, wherein the vibration-resistant protrusion is provided with at least two plate-like protrusions, and the vibration-resistant protrusion-inserted groove is cut into a wedged shape into which the vibration-resistant protrusion is to be inserted, and wherein when fitting the first connector member with the second connector member, the vibration-resistant protrusion is inserted into the vibration-resistant protrusion-inserted groove.

* * * * *